US010945476B2

(12) United States Patent
Huang

(10) Patent No.: US 10,945,476 B2
(45) Date of Patent: Mar. 16, 2021

(54) MECHANICAL-MAGNETIC LOCKING DEVICE

(71) Applicant: Shenzhen City Aikang Weida Intelligent medical technology co., ltd, Shenzhen (CN)

(72) Inventor: Wei Huang, Shenzhen (CN)

(73) Assignee: SHENZHEN CITY AIKANG WEIDA INTELLIGENT MEDICAL TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 16/587,086

(22) Filed: Sep. 30, 2019

(65) Prior Publication Data

US 2020/0154804 A1 May 21, 2020

(30) Foreign Application Priority Data

| | | |
|---|---|---|
| Nov. 20, 2018 | (CN) | 201811383581.6 |
| Nov. 30, 2018 | (CN) | 201811456198.9 |
| Jan. 25, 2019 | (CN) | 201910074088.4 |
| May 15, 2019 | (CN) | 201920707928.1 |

(51) Int. Cl.

| | |
|---|---|
| ***A41F 1/00*** | (2006.01) |
| ***A44B 11/00*** | (2006.01) |
| *E05B 65/52* | (2006.01) |
| *E05B 47/00* | (2006.01) |

(52) U.S. Cl.

CPC ..... *A41F 1/002* (2013.01); *A44B 11/006* (2013.01); *A44D 2203/00* (2013.01); *E05B 47/0038* (2013.01); *E05B 65/52* (2013.01)

(58) Field of Classification Search

CPC ... A41F 1/002; A44B 11/006; A44B 11/2588; A44B 11/2596; A44B 11/28; A44D 2203/00; E05B 47/0038; E05B 65/52

See application file for complete search history.

(56) References Cited

U.S. PATENT DOCUMENTS 2,615,227 A * 10/1952 Hornik ..... A44C 5/2071 24/303
3,376,616 A * 4/1968 Kaczorowski ..... A44B 11/258 24/303

(Continued)

*Primary Examiner* — Robert Sandy
*Assistant Examiner* — David M Upchurch
(74) *Attorney, Agent, or Firm* — Bayramoglu Law Offices LLC

(57) ABSTRACT

A mechanical-magnetic locking device includes a first connecting component, a second connecting component and a magnet-armature structure. The first connecting component is provided with a locking element with a gap. The second connecting component is provided with a locking member matched with the locking element with the gap. A magnet is provided in one connecting component and an armature is provided in the other connecting component. The locking element with the gap is coupled with the magnet and the armature is coupled with the locking member. When opening the locking device, the magnet and the armature are relatively moved to each other, and the magnetic attracting area is substantially unchanged or increased, allowing the locking element with the gap and the locking member to move from the engaged position to the non-engaged position.

20 Claims, 22 Drawing Sheets

(56) References Cited

U.S. PATENT DOCUMENTS

| | | | | | |
|---|---|---|---|---|---|
| 5,125,134 | A * | 6/1992 | Morita | A44C 5/2071 | 24/303 |
| 5,369,323 | A * | 11/1994 | Allwine, Jr. | G01B 7/30 | 310/192 |
| 6,598,271 | B2 * | 7/2003 | Nire | A41F 1/002 | 24/265 WS |
| D642,954 | S * | 8/2011 | Humphries | D11/87 | |
| 8,002,572 | B2 * | 8/2011 | Lu | H01R 13/65915 | 439/405 |
| 8,800,117 | B2 * | 8/2014 | Fiedler | A44B 11/258 | 24/303 |
| 9,907,367 | B2 * | 3/2018 | Paik | A41F 1/002 | |
| 10,111,500 | B2 * | 10/2018 | Lambert | A44B 11/28 | |
| 10,376,022 | B2 * | 8/2019 | Duncan | H01F 7/0263 | |
| 2009/0269943 | A1 * | 10/2009 | Palli | H01R 13/6205 | 439/39 |
| 2012/0248793 | A1 * | 10/2012 | Fiedler | A44B 11/2592 | 292/163 |
| 2012/0255144 | A1 * | 10/2012 | Gaudillere | A44B 11/266 | 24/303 |
| 2016/0037870 | A1 * | 2/2016 | Perkins | A44B 11/263 | 24/664 |
| 2019/0069612 | A1 * | 3/2019 | Hyde | A44B 11/2546 | |

* cited by examiner

A-A

A-A

B-B

MECHANICAL-MAGNETIC LOCKING DEVICE

CROSS REFERENCE TO THE RELATED APPLICATIONS

This application is based upon and claims priority to Chinese Patent Application No. 201811383581.6, filed on Nov. 20, 2018, Chinese Patent Application No. 201811456198.9, filed on Nov. 30, 2018, Chinese Patent Application No. 201910074088.4, filed on Jan. 25, 2019, and Chinese Patent Application No. 201920707928.1, filed on May 15, 2019, the entire contents of which are incorporated herein by reference.

TECHNICAL FIELD

The present invention relates to a magnetic mechanical connection mechanism, and in particular to a locking device with a multi-position adjustment.

BACKGROUND

Existing mechanical connection structures, such as snap fasteners and latch structures, have unlocking and locking mechanisms generally formed by a combination of components matched to one another in shape. Elastic materials are generally used, and an elastic force is overcome to realize assembly during locking and unlocking. Such a structure can even ensure locking under an extremely strong load, and mechanical connection structures with such self-locking function are widely used in the art.

Another main connection structure is a connection structure with an additional magnetic force. The magnetic force is used to tension the connection mechanism or provide a good haptic for locking and unlocking. Such magnetic structure is also widely used in the fields such as garment snap fasteners, handbag latches, and notebook opening and closing devices, etc.

However, for such magnetic structures, the magnetic force is generally and simply used as an auxiliary for enhancing a locking force or providing the good haptic, causing a poor user experience.

SUMMARY

A mechanical-magnetic locking device provided by the present invention includes a first connecting component, a second connecting component and a magnet-armature structure; wherein the first connecting component is provided with a locking element with a gap, the second connecting component is provided with a locking member matched with the locking element with the gap; a magnet is provided on the first connecting component or the second connecting component, and an armature is correspondingly provided on the second connecting component or the first connecting component; the magnet or the armature is coupled to the locking element with the gap, and the armature or the magnet is coupled to the locking member;

during locking of the locking device, the magnet and the armature approach each other, and the locking element with the gap and the locking member are moved from a non-engaged position to an engaged position by an attractive magnetic force to form locking; and when opening the locking device, the magnet moves relative to the armature, and a magnetic attracting area is substantially constant or increased, allowing the locking element with the gap and the locking member to be moved from the engaged position to the non-engaged position; upon reaching the non-engaged position, the magnet moves relatively away from the armature until the magnetic force between the magnet and the armature is sufficiently weakened to separate the first connecting component from the second connecting component.

The engaged position is a position where the locking element with the gap is locked with the locking member in a shape matching manner.

The non-engaged position is a position where the locking element with the gap and the locking member are unlocked.

In the present application, the magnetic attracting area is defined by an area of an overlap region of projections. When the magnet and the armature in a single magnet-armature pair face-to-face attract each other, two single-pole magnetic pole faces (north (N)-pole face or south (S)-pole face) of the single magnet-armature pair are orthogonally projected to a same plane, and an area of an overlap region of the two projection regions is defined as the magnetic attracting area of the magnet-armature structure. When at least one of the two magnetic pole faces is a plane, the plane in which the plane magnetic pole face is located is the projection plane. When the two magnetic pole faces are curved surfaces, a vertical plane of a line connecting centers of the two curved surfaces is the projection plane.

A length of a line segment formed by projecting the line connecting the centers of the two single-pole magnetic pole faces attracted to each other in a direction perpendicular to the projection plane is defined as an average spacing.

The single-pole magnetic pole face in the present application means that the magnetic pole face has only a single pole, N pole or S pole.

When the magnet-armature structure includes a plurality of single magnet-armature pairs, a magnetic attracting area of the magnet-armature structure is a sum of the plurality of single magnet-armature pairs.

When the magnet-armature structure includes one magnet and a plurality of armatures, a magnetic attracting area of the magnet-armature structure is calculated as follows: first calculating a magnetic attracting area between a single armature and the magnet, and then adding up a plurality of magnetic attracting areas. The calculation method is also applied to a case where a plurality of magnets and one armature are contained.

It is known to those skilled in the art that the armature in the magnet-armature structure is made of a ferromagnetic material or may also be a magnet. Therefore, the magnet-armature structure below is at least one selected from the group consisting of a combination of a magnet and an armature attracted to each other, and a combination of a magnet and a magnet attracted to each other.

Some magnet-armature structures not only attract each other, but repel each other if they have two like poles.

In the magnet-armature structure, a size, a shape, and a position of the magnet are arbitrary. Similarly, a size, a shape, and a position of the armature is arbitrary.

Preferably, the magnet is unequal to the armature in size, and the magnet is not directly aligned with the armature when the locking element with the gap is engaged with the locking member. The design of the non-direct alignment can make a use of a relatively high density of the magnetic field of the magnet at the tip.

The direct alignment setting means that a centerline of the magnet is collinear with a centerline of the armature. The collinearity allows for an error within 10% in actual product applications; and more preferably, allows an error within 5%.

Preferably, the magnet-armature structure includes one or more magnet-armature pairs. The magnet-armature pairs are collectively referred to the magnet-armature structure, and the number of magnet-armature pairs is not limited in the magnet-armature structure. Therefore, the number of magnets may be one or more, and the number of corresponding armatures may be one or more as well, providing a reasonable distribution of the magnetic force or enhancing the magnetic force, but not changing the action principle thereof, which is obvious to one of ordinary skill in the art.

In a normal case, a movement of the magnet relative to the armature has the same effect as a movement of the armature relative to the magnet. Similarly, a direct interaction between the magnet and the armature has the same property as an interaction between two magnets attracted to each other.

Approaching each other is not limited to a straight-line approaching, but may also approach in a motion manner of rotation, flipping, or a combination of the above motion manners. Specifically, the straight-line approaching includes a forward approaching and a side approaching. In the present application, the rotation refers to a circular motion of an object along a central rotation axis; and the flipping refers to a circular motion of an object along a side rotation axis located at an edge of the object.

When the magnet and the armature forward approach each other, the average spacing is decreased, and the magnetic attracting area is substantially unchanged.

When the magnet and the armature side approach each other, the average spacing is substantially unchanged, and the magnetic attracting area is increased.

In the present application, a substantially unchanged does not mean constant values in a mathematical sense, but refers to a variation range within ±10%, more preferably within ±5%. Similarly, an increase or decrease in the present application does not mean an increase or decrease in the mathematical sense, but should be understood as a general tendency of increase or decrease, which dies not exclude that some part is not changed.

In general, an attractive magnetic force between two magnets is related to the magnetic attracting area and the average spacing. The magnetic attracting area is positively correlated with the magnetic force, that is, the larger the magnetic attracting area, the larger the magnetic force; the average spacing is negatively correlated with the magnetic force, that is, the larger the average spacing, the smaller the magnetic force.

Preferably, during a locking process of the locking device, when the magnet and the armature approach each other, the locking element with the gap and the locking member are moved from the non-engaged position to the engaged position under the attractive magnetic force. Approaching each other in the locking process may be the side approaching, the forward approaching, or approaching in other ways, as long as they are capable of generating an attractive magnetic force.

Preferably, during opening, when the locking element with the gap and the locking member are moved from the engaged position to the non-engaged position, a relative movement between the magnet and the armature includes one movement or a combination of at least two movements selected from the group consisting of a forward straight-line moving away, a side straight-line approaching, a forward flipping, and a rotation.

Preferably, during opening, when the locking element with the gap and the locking member are moved from the engaged position to the non-engaged position, a relative movement between the magnet and the armature includes one movement or a combination of at least two movements selected from the group consisting of a forward straight-line moving away, a side straight-line approaching, and a forward flipping. The attractive magnetic force between the magnet and the armature provides at least a part of a restoring force for the locking element with the gap and the locking member to be reset to the engaged state after being forced to move by an external force.

After the locking element with the gap and the locking member reach the non-engaged position during opening, a relative movement that the magnet moves away from the armature includes: one movement or a combination of two movements selected from the group consisting of a forward straight-line moving away, a side moving away, and a flipping; or a combination of a forward straight-line moving away and a rotation; or other moving away manners capable of weakening the magnetic force between the magnet and the armature.

The side moving away is a movement during which the average spacing is substantially unchanged and the magnetic attracting area is decreased.

The forward straight-line moving away of the magnet from the armature is a movement during which the average spacing is increased and the magnetic attracting area is substantially unchanged. Substantially unchanging does not mean a constant value in the mathematical sense, but means the variation range within ±10%, more preferably within +5%.

After the locking element with the gap and the locking member reach the non-engaged position during opening, when the relative flipping occurs between the magnet and the armature, the average spacing between the magnet and the armature increases compared to that at the engaged position.

The relative flipping includes a forward flipping and a side flipping.

The forward flipping is a flipping increasing the average spacing and gradually increasing the magnetic attracting area; and the side flipping is a flipping increasing the average spacing and gradually decreasing the magnetic attracting area.

Preferably, during opening, the locking element with the gap and the locking member are moved from the engaged position to the non-engaged position, the forward flipping is performed between the magnet and the armature, the magnetic attracting area is increased, and the attractive magnetic force between the magnet and the armature is overcome by an external force, allowing the locking element with the gap and the locking member to be moved from the engaged position to the non-engaged position.

After the locking element with the gap and the locking member reach the non-engaged position during opening, the relatively moving away of the magnet from the armature may be one or a combination of the two selected from the group consisting of a forward flipping and a side flipping.

In the present application, the process of separating the first connecting component from the second connecting component by flipping includes: the locking element with the gap and the locking member are moved from the engaged position to the non-engaged position after forward flipping at a certain angle; after reaching the non-engaged position, the forward flipping is continued, the average spacing between the magnet and the armature increases, and the magnetic attracting area continues to increase, and the area of the magnetic force reaches a maximum when the locking element with the gap and the locking member flip to a critical position; continuing to flip in the original direction and angular velocity, the area of magnetic attraction is gradually decreased, i.e., the side flipping is performed, until the magnetic force between the magnet and the armature is sufficiently weakened to separate the first connecting component from the second connecting component.

Preferably, the magnet and the armature are forward moved away from each other, and the magnetic attracting area is substantially unchanged, the attractive magnetic force between the magnet and the armature is overcome by the external force, allowing the locking element with the gap and the locking member to be moved from the engaged position to the non-engaged position. In this case, the magnetic attraction between the magnet and the armature in the forward moving away is gradually weakened.

Preferably, the relative movement between the magnet and the armature may be a resultant movement of a forward moving away and a side approaching, the average spacing between the magnet and the armature increases, the magnetic attracting area increases, and the magnetic force between the magnet and the armature is overcome by the external force, allowing the locking element with the gap and the locking member to be moved from the engaged position to the non-engaged position. In this case, when the magnet and the armature move relative to each other, the change of the attractive magnetic force between the magnet and the armature is a result of a synergistic effect of the increase of the average spacing and the increase of the magnetic attracting area. In the present application, a changing curve of the attractive magnetic force is adjusted by selecting an appropriate magnetic field density, a velocity of the forward moving away, a velocity of the side approaching, and an area of the magnetic pole.

Preferably, the magnet and the armature are relatively rotated, and the magnetic attracting area is substantially unchanged, allowing the locking element with the gap and the locking member to be moved from the engaged position to the non-engaged position. In this case, the magnet and the armature are relatively rotated, the attractive magnetic force between the magnet and the armature is substantially unchanged.

Preferably, during opening the locking device, the magnet and the armature are forward moved away, and the locking element with the gap and the locking member are moved from the engaged position to the non-engaged position, and after reaching the non-engaged position, the magnetic force between the magnet and the armature is sufficiently weakened to separate the first connecting component from the second connecting component. In this case, during the process from the moment that the locking device is ready to be opened to the moment that the first connecting component is separated from the second connecting component, the relative movement between the magnet and the armature is the forward moving away.

Preferably, when opening the locking device, the magnet and the armature are relatively rotated, and the magnetic attracting area is substantially unchanged, allowing the locking element with the gap and the locking member to be moved from the engaged position to the non-engaged position. After reaching the non-engaged position, the magnet and the armature are forward moved away until the magnetic force between the magnet and the armature is sufficiently weakened to separate the first connecting component from the second connecting component.

Preferably, when opening the locking device, the magnet and the armature are flipped to each other, the magnetic attracting area is increased, and the magnetic force between the magnet and the armature is overcome by the external force, allowing the locking element with the gap and the locking member to be moved from the engaged position to the non-engaged position. After reaching the non-engaged position, the magnet and the armature continue to flip until the magnetic force between the magnet and the armature is sufficiently weakened to separate the first connecting component from the second connecting component. In this case, during the process from the moment that the locking device is ready to be opened to the moment that the first connecting component is separated from the second connecting component, the relative movement between the magnet and the armature is the flipping, but changes from the forward flipping at the beginning to the subsequent side flipping.

Preferably, when opening the locking device, the magnet and the armature are forward flipped, the magnetic attracting area is increased, and the attractive magnetic force between the magnet and the armature is overcome by the external force, allowing the locking element with the gap and the locking member to be moved from the engaged position to the non-engaged position. After reaching the non-engaged position, the magnet and the armature continue to flip forward to reach the critical position of the flipping, then the magnet and the armature are subjected to the side moving away or the forward moving away until the magnetic force between the magnet and the armature is sufficiently weakened to separate the first connecting component from the second connecting component.

Preferably, at least one of the first connecting component and the second connecting component is provided with an elastic structure.

The provided elastic structure includes: the locking element with the gap in the first connecting component may be an elastic structure, or the locking element with the gap may be a rigid structure, and the first connecting component further includes an elastic member, allowing the locking element with the gap to generate an elastic displacement when being squeezed. Similarly, the locking member in the second connecting component may be an elastic structure, or the locking member may be a rigid structure, and the second connecting component further includes an elastic member, allowing the locking member to generate an elastic displacement when being squeezed. The elastic member may be provided on the locking element with the gap or the locking member, or may be provided at a position on the first connecting component other than the locking element with the gap or at a position on the second connecting component other than the locking member.

Preferably, the elastic member includes a spring.

Preferably, the locking element with the gap is a rigid structure, and the locking member is an elastic locking member.

Preferably, the locking element with the gap is an elastic locking element with a gap, and the locking member is a rigid structure.

Preferably, the locking element with the gap is a rigid structure, and the locking member is a rigid locking member. The phrase "rigid" means that deformation does not occur substantially during use.

Preferably, the locking element with the gap is an elastic locking position, and the locking member is an elastic locking member.

Preferably, the elastic locking member is a locking member including an elastic structure.

The phrase "elastic" means that the locking member itself has elasticity, that is, an elastic deformation occurs under an external force. If the external force disappears, the deformation recovers.

Preferably, the elastic locking member includes an elastic member and a rigid locking element, the elastic member includes a spring; that is, an elasticity of the elastic locking member is provided by an elastic force of the elastic member.

When at least one of the first connecting component and the second connecting component is provided with the elastic structure, the elastic force of the locking element with the gap and/or the locking member should be overcome when the locking element with the gap is engaged with the locking member. During locking, the attractive magnetic force created by the magnet and the armature facilitates smooth engagement of the first connecting component with the second connecting component. In the engaged state, the first connecting component and the second connecting component form a locked state in a main load direction.

Preferably, the main load direction formed when the locking element with the gap is engaged with the locking member is at an obtuse angle or a right angle to an opening direction. The design of the obtuse angle allows the main load to decompose a certain component force in an opposite direction of the opening direction, achieving the advantage that the locking device will not open automatically under a condition of a relatively large load. The opening direction is a direction of the locking device from the engaged position to the non-engaged position.

Preferably, the locking member is provided with a hook-shaped head or a protrusion, and the locking element with the gap is correspondingly provided with a groove.

After the locking element with the gap is engaged with the locking member, the hook-shaped head of the locking member hooks into the groove of the locking element with the gap to form an embedded connection, and locking is achieved in the main load direction. In order to realize a self-locking under a load, and prevent opening under a heavy load, an engaged direction between the hook-shaped head and the groove is at an acute angle to a direction of the load.

The engaged direction is a direction opposite to a direction in which the locking member slides off in an elastic offset direction on a contact surface when the protrusion of the locking member and the groove of the locking element with the gap are squeezed and contact each other.

The direction in which the hook-shaped head of the locking member is engaged with the groove of the locking element with the gap is at an acute angle to the main load force direction, allowing a resultant force applied on the locking member to form a component force in an opposite direction of an elastic offset direction of the locking member when the main load force makes the hook-shaped head of the elastic locking member squeezed with the groove of the locking element with the gap, thereby achieving the advantage that the locking device will not automatically open under the condition of a relatively large load.

Preferably, a width of the groove of the locking element with the gap in the first connecting component is greater than a width of a hook-shaped head of the locking member. That is, a projection length of the groove of the locking element with the gap in the main load direction is greater than a projection length of the hook-shaped head.

Obviously, in other preferred embodiments, the groove may be provided on the locking member, and the locking element with the gap is provided with the hook-shaped head or the protrusion.

The groove is paired with the hook-shaped head in structure to form a self-locking is a common technique in the art, and other structural designs are presented as well. One of ordinary skill in the art will recognize that as long as the locking element with the gap and the locking member are paired in a structure to form the self-locking, the same effect can be achieved.

Taking the rigid locking element with the gap and the elastic locking member as an example, only at the moment when the locking element with the gap is being engaged with the elastic locking member, the locking member is in an elastic deformation state, and after the engagement is completed, the locking member is in an unstressed state.

If the two connecting components are engaged, then a mechanical locking and a magnetic force are presented. However, it should be noted that the magnetic force can merely resist a small part of the main load force that the locking device bears after the engagement, most of the main load force is borne by the mechanical structure, and the magnetic force is mainly used to promote the engagement.

Preferably, the first connecting component is provided with one or more locking elements with gaps along the main load direction, and the one or more locking elements with gaps are correspondingly provided with one or more magnets or armatures. The locking element with the gaps are in one-to-one correspondence with and coupled to the magnets or the armatures.

Each locking element with the gap should be coupled to one magnet or armature, so that at a moment when the locking member is engaged, a mutual attraction between the magnet and the armature overcomes an elasticity of the locking member, making the connection smoother.

Preferably, two adjacent locking elements with gaps of the plurality of locking elements with gaps share one magnet, each locking element with the gap corresponds to one pole (N pole or S pole) of the magnet, and the locking member is correspondingly provided with an armature. In this arrangement, the locking element with the gap and the locking member can only use the magnet-armature pair structure.

Preferably, the coupling is a rigid connection or an elastic connection between the locking element with the gap and the magnet.

Preferably, the coupling is achieved by a coupling device.

Preferably, the coupling device has a gap along the opening direction.

The coupling device may have a gap along the opening direction, so that the locking element with the gap is driven to move relative to the locking member when the gap is used up. During the magnet moving away from the armature, the magnetic force is weakened, and when the locking element with the gap is driven to be separated from the locking member, the magnetic force to be overcome is relatively small, and the good haptic of the opening can be improved.

Preferably, the coupling device is a coupling spring.

An elastic force of the coupling spring spreads along the opening direction, wherein a frictional force is greater than the elastic force of the spring when the locking element with the gap and the locking member are moved relative to each other in the opening direction.

Similarly, the elastic locking member is coupled to the armature or magnet.

In some structural designs, alternatively, the first connecting component may be provided with the locking member, the locking member is coupled to the magnet, and the second connecting component is provided with the locking element with the gap. This structure can also achieve the same advantages as the above structural design, which can be conceived by those skilled in the art without creative labor.

Preferably, the first connecting component is provided with one or a plurality of locking elements with gaps, and the second connecting component is provided with a locking member. The locking member can be engaged with one of the plurality of locking elements with gaps to form a locked state as needed, so a multi-position adjustment can be provided.

Preferably, the first connecting component is provided with a plurality of locking elements with gaps in a direction parallel to the main load direction.

Preferably, the first connecting component is provided with a plurality of locking elements with gaps in a direction parallel to the main load direction, and the second connecting component is provided with a locking member. The locking member can be engaged with one of the plurality of locking elements with gaps to form a locked state as needed, so a multi-position adjustment can be provided.

Preferably, the first connecting component is provided with a plurality of locking elements with gaps s (a first locking element with a gap, a second locking element with a gap, . . . , an $N^{th}$ locking element with a gap) in a direction parallel to the main load direction. The first locking element with the gap forms a first position when being engaged with the locking member, and a second position is formed by continuing to advance along the engagement direction, . . . , and so on.

Each position forms a locked state in the main load direction, that is, when the locking element with the gap and the locking member are engaged in a certain position, only a pushing toward a next position is allowed, and a movement to the main load direction is not allowed.

In some structural designs, alternatively, the first connecting component may be provided with a plurality of locking members, each locking member is coupled to the magnet, and the second connecting component is provided with a locking element with a gap. This structure can also achieve the same advantage as the above structural design, which can be conceived by those skilled in the art without creative labor.

Preferably, the second connecting component includes a plurality of locking members or one locking member having a plurality of locking segments. A direction of arranging the plurality of locking segments is not consistent with the direction in which the locking element with the gap is engaged with the locking member. An improvement in the force distribution can be achieved by this design.

Preferably, a guiding plate is provided in the connecting component. The guiding plate is configured to make the magnet and the armature of the locking device not in a direct contact with each other, avoiding surface damage caused by a relative movement between the magnet and the armature when in the direct contact with each other.

Preferably, the first connecting component and the second connecting component of the locking device are respectively designed to have a tilting or a chamfer. The design of the tilting or the chamfer facilitates the engagement of the first connecting component with the second connecting component.

Preferably, an initial contact surface where the locking element with the gap is engaged with the locking member is designed to have a tilting or a chamfer.

Preferably, the first connecting component and the second connecting component of the locking device are provided with gaps to facilitate the engagement of the first connecting component with the second connecting component.

Preferably, the locking device further includes a cavity, and the cavity contains a functional module and a power source.

Preferably, the functional module includes a smart step counting module or/and a light-emitting module. The step counting module has functions of recording walking or running steps, a walking posture, a running posture, a running impact force, a foot lifting time, a foot landing time, a foot lifting height, and the like of a user. The light-emitting module has functions of emitting light of different colors or different flickering modes according to the walking, the running, the running posture, the running impact force, and the like of the user.

Preferably, the locking device is further provided with a baffle for protecting the elastic locking member or/and the elastic locking element with the gap from an excessive deformation damage under conditions of abnormal use.

The present invention includes the following advantages.

a) Automatic locking function is provided.

b) Locking states of different positions can be adjusted to meet locking requirements of different degrees of tightness or different lengths.

c) The connection is smoother and the good haptic is good.

d) It is not easy to open after connection, thus is stable and reliable.

Figure 1A:
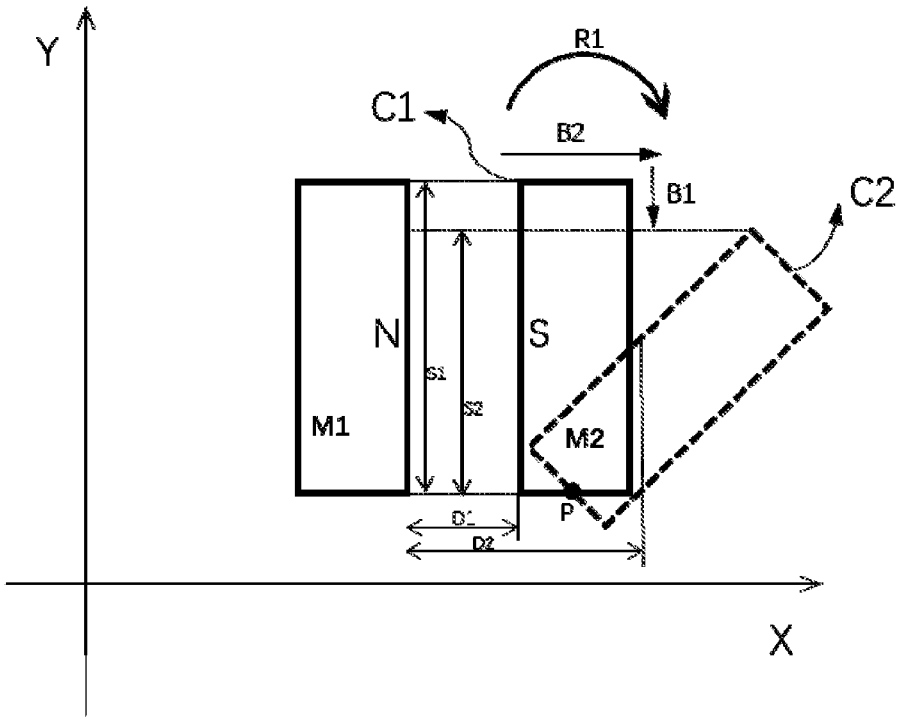
FIGS. 1A-1D are schematic diagrams illustrating meanings of "forward moving away", "side moving away", "side approaching", "forward flipping", and "side flipping" of the present invention.

A list of main reference numerals in the figures are described below:

| | |
|---|---|
| 1, 11, 21, 31, 41, 51, 61 | First connecting component |
| 2, 12, 22, 32, 42, 52, 62 | Second connecting component |
| 4, 13, 23, 33, 53, 63 | Elastic locking member |
| 43 | Rigid locking member |
| 5, 14, 24, 34, 44, 54, 64 | Locking element with a gap |
| 6 | Baffle |
| M1, M2, M3 | Magnet |
| S | S pole |
| N | N pole |
| C1, C2 | Position marker |
| S1, S2 . . . | Magnetic attracting area |
| D1, D2 . . . | Average spacing |
| P | Rotation axis |
| A1, A4 | Engagement direction |
| A2 | Opening direction |
| A3 | Elastic offset direction |
| B1, B2, B3 | Moving direction |
| R1 | Rotating direction |

DETAILED DESCRIPTION OF THE EMBODIMENTS

The present invention is further described with reference to the accompanying drawings and embodiments.

In the present invention, the general functions and the meanings of "forward moving away", "side moving away", "side approaching", "forward flipping", and "side flipping" are explained by the schematic diagrams shown in FIGS. 1*a*-1*d*. The following magnets M1 and M2 are shown in the schematic diagrams.

Schematic Diagram 1

FIG. 1A is a schematic diagram showing a relative movement between a magnet and an armature or between a magnet and a magnet in a straight line, where a pole face is a plane.

The N pole of the magnet M1 and the S pole of the magnet M2 forward attract each other, and the N pole face and the S pole face are substantially equal in size. The S pole face of M2 is projected on the plane where the N pole face of M1 is located, and the area of the overlap region between the projection region and the N pole face of M1 is S1, i.e., the magnetic attracting area. When M1 is set to be fixed, and M2 moves in the B1 direction from a current position, the magnetic attracting area S1 is gradually decreased, and the average spacing D1 of the magnets is substantially unchanged, thus the magnetic force is weakened, and the B1 direction is defined as a direction of side moving away between M1 and M2. When M2 moves in an opposite direction of the B1 direction, a same effect can be realized. If M2 moves in the B2 direction, then the magnetic attracting area S1 is substantially unchanged, while the average spacing D1 of the magnets is gradually increased, thus the magnetic force is weakened, and the B2 direction is defined as a direction of forward moving away between M1 and M2. The R1 direction shown in the figure is a direction of flipping around the P axis, and a flipping axis is perpendicular to the X and Y axises, i.e., a clockwise direction. If M2 is flipped in the R1 direction and moved from the C1 state to the C2 state, then the magnetic attracting area is decreased from S1 to S2, and the average spacing of the magnets is gradually increased from D1 to D2, thus the magnetic force is weakened. At this time, the flipping in the R1 direction is defined as the side flipping.

Figure 1B:
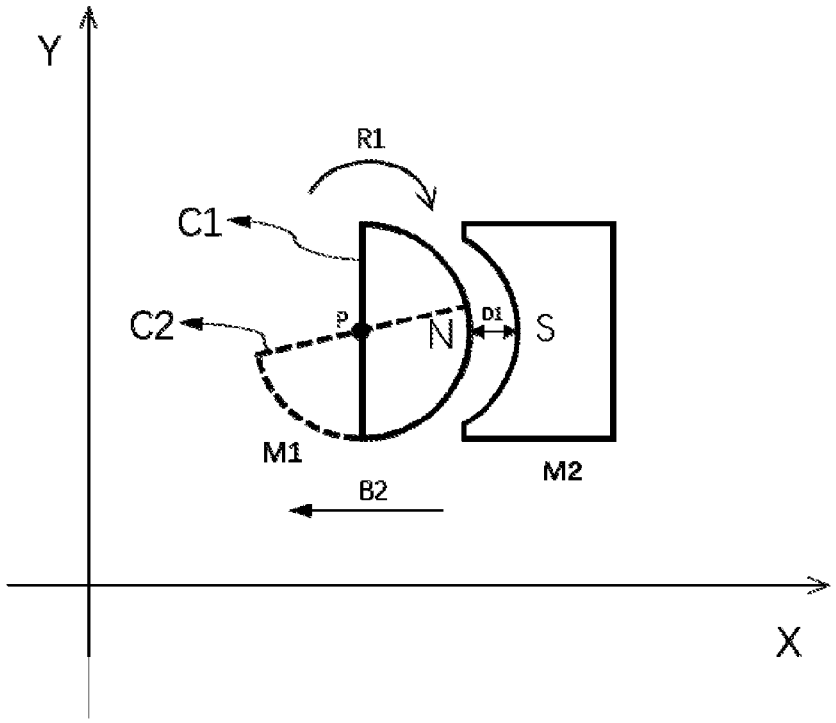

FIG. 1B is a schematic diagram showing a relative rotation and movement between a magnet and an armature or between a magnet and a magnet, where a pole surface is a curved surface.

The N pole of the magnet M1 and the S pole of the magnet M2 attract toward each other. An attracting surface is a curved surface. In this embodiment, a projection direction is an opposite direction of the B2 direction. Then, an overlap area of projections of the N pole face of M1 and the S pole face of M2 on a vertical plane of the opposite direction of the B2 direction is the magnetic attracting area. When M2 is set to be fixed, and M1 rotates clockwise in the R1 direction at a current position from the C1 state to the C2 state, the magnetic attracting area is gradually decreased, and the average spacing D1 of the magnets is substantially unchanged, thus the magnetic force is weakened, and the R1 direction is defined as a direction of side rotation between M1 and M2. When M1 rotates in an opposite direction of R1, a same effect can be realized. If M1 moves in the B2 direction, then the magnetic attracting area is substantially unchanged, while the average spacing D1 of the magnets is gradually increased, thus the magnetic force is weakened, and the B2 direction is defined as a direction of forward moving away between M1 and M2.

Figure 1C:
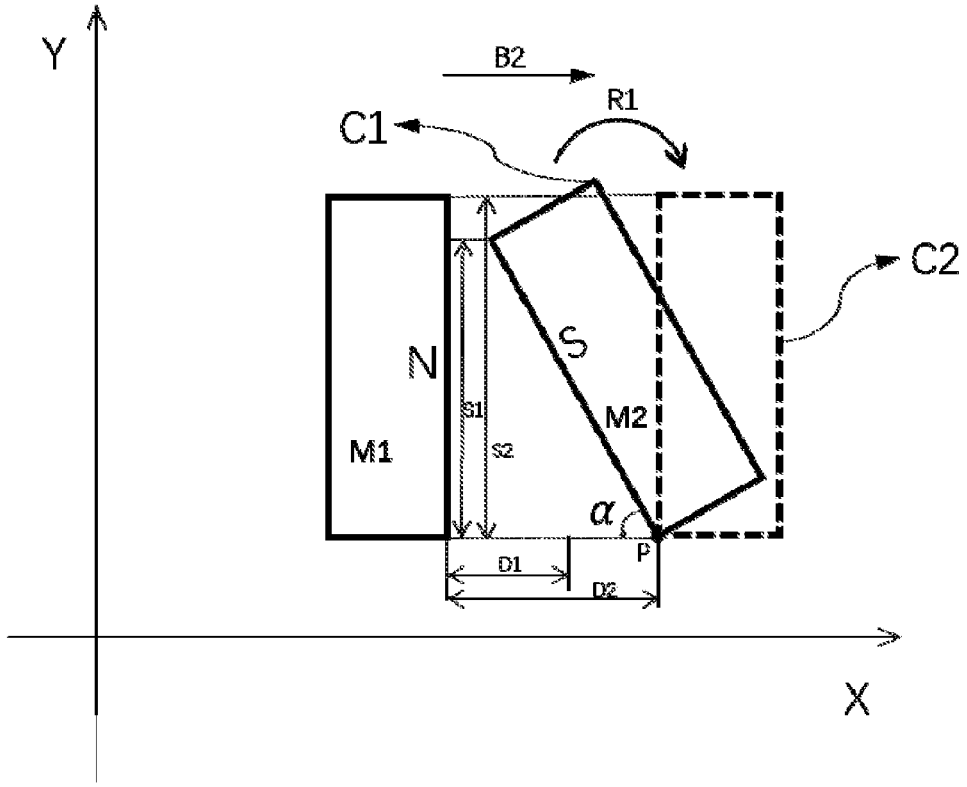

FIG. 1C is a schematic diagram showing a relative flipping and movement between a magnet and an armature or between a magnet and a magnet, where a pole face is a plane, but an initial position (engagement position) has an inclination angle.

The N pole of the magnet M1 and the S pole of the magnet M2 attract toward each other. The S pole face of M2 is projected on a plane where the N pole face of M1 is located, and an area of an overlap region between a projection region and the N pole face of M1 is S1, i.e., the magnetic attracting area. When the predetermined M1 is fixed, and M2 moves in the B2 direction at a current position, the magnetic attracting area S1 is substantially unchanged, and the average spacing D1 of the magnets is gradually increased, thus the magnetic force is weakened. If M2 is flipped clockwise in the R1 direction with the P axis as the flipping axis in the current position from C1 to the critical position C2, then the magnetic attracting area is increased from S1 to S2, the average spacing of the magnet is gradually increased from D1 to D2, and at this time, the flipping in the R1 direction is defined as the forward flipping. During the process of flipping from C1 to C2, a magnetic force may be generally weakened, enhanced, unchanged, or a combination of at least two of the three states. By adjusting the magnetic attracting area and a magnetic density at an initial position, the magnetic force is generally weakened during the process of flipping from C1 to C2, without excluding local enhancement or unchangeableness. If M2 continues to be flipped in the R1 direction after reaching the C2 position, then the magnetic attracting area S2 begins to decrease, the average spacing D2 of the magnets continues to increase, and the magnetic force is continuously weakened until the magnetic force between M1 and M2 is sufficiently weakened for separation, therefore, the position C2 is a critical state that distinguishes the forward flipping from the side flipping.

Figure 1D:
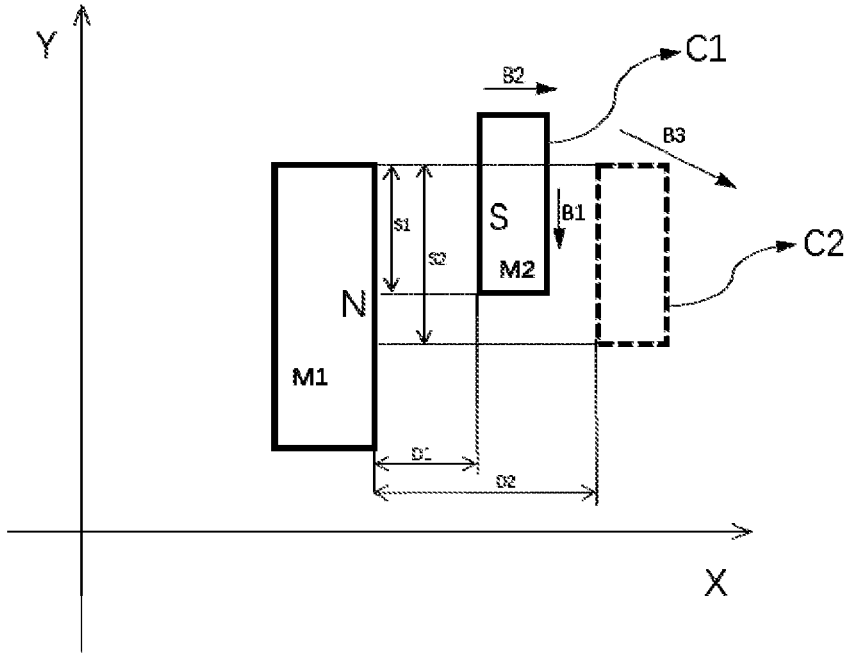

FIG. 1D shows a case where the magnet is unequal to the armature in size and the positions of the magnet and the armature are not directly aligned. a direct alignment means that a centerline of M1 is collinear with a centerline of M2. A collineation allows an error within 10% in actual product applications; more preferably, an error within 5%. Changes of the three different moving directions B1, B2 and B3 are analyzed by taking the C1 position shown in FIG. 1D as an initial position.

When the magnet M2 moves downward in the B1 direction, the magnetic attracting area begins to increase and reaches a maximum when an upper bottom surface is flush with M1, and a moving process in this duration is defined as the side approaching. Until a lower bottom surface of M2 is flush with M1, the magnetic attracting area is continuously maintained at the maximum. If M2 continues to move in the B1 direction, the magnetic attracting area begins to decrease, and the average spacing D1 remains unchanged. In the whole process, a corresponding magnetic force is changed as follows: first increasing, then reaching the maximum and keeping stable, and finally gradually weakening.

When the magnet M2 moves rightward in the B2 direction, the magnetic attracting area remains substantially unchanged, the average spacing D1 increases, and the magnetic force gradually decreases.

When the magnet M2 moves to rightward and downward in the B3 direction from the C1 position to the C2 position, a movement in the B3 direction is decomposed into sub-movements in the B1 and B2 directions. The sub-movement in the B1 direction is the side approaching, making the magnetic attracting area increased from S1 to S2. The sub-movement in the B2 direction is forward moving away, making the average spacing increased from D1 to D2. There may be two cases of changes in the magnetic force, the first case is that the magnetic force is increased first and then decreased; and the second case is that magnetic force is gradually decreased. In a condition where the other conditions are unchanged, effects of the two different changes in the magnetic force are determined by B3, or determined by a forward moving away velocity and a side approaching velocity.

Schematic Diagram 2

Figure 2A:
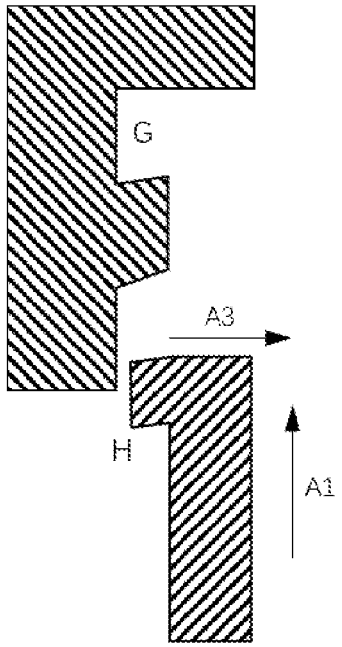
FIGS. 2A-C are schematic diagrams showing a self-locking formed by matching a hook-shaped head with a groove in shape in the present invention.
Figure 2B:
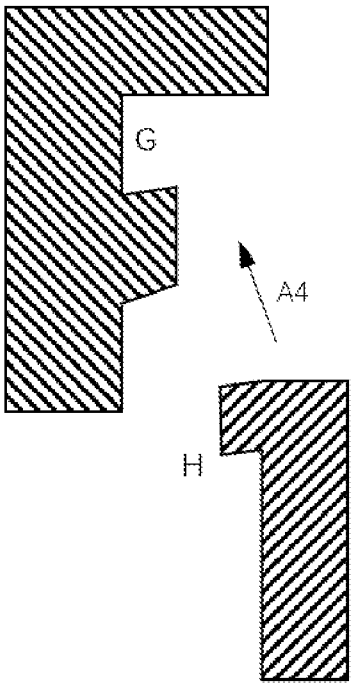
Figure 2C:
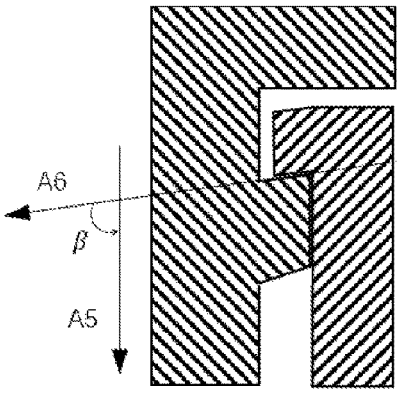

FIGS. 2A-C show a principle of a self-locking formed by matching a hook-shaped head with a groove in shape. In the figures, G denotes the groove, and H denotes the hook-shaped head.

In the state of FIG. 2C, the groove is engaged with the hook-shaped head to form a locking in the A5 direction. The A5 direction is the main load direction, and the angle between A5 and A6 is an acute angle t, so that the groove and the hook-shaped head form a self-locking.

At the position of FIG. 2A, H advances in the A1 direction to reach the engaged state of FIG. 2C, and H will produce an elastic offset in the A3 direction at a moment when H is engaged into G. When the engaged state of FIG. 2C is reached, the elastic offset disappears.

At the initial position of FIG. 2B, H reaches the engaged state of FIG. 2C along the A4 direction or other paths, and H may not have an elastic property.

Schematic Diagram 3

The first connecting component and the second connecting component to be connected are denoted by reference numerals 1 and 2. The two connecting components are separated by the separating line 3 for the sake of clarity, and the two connecting components are thus arranged side by side at intervals.

Figure 3A:
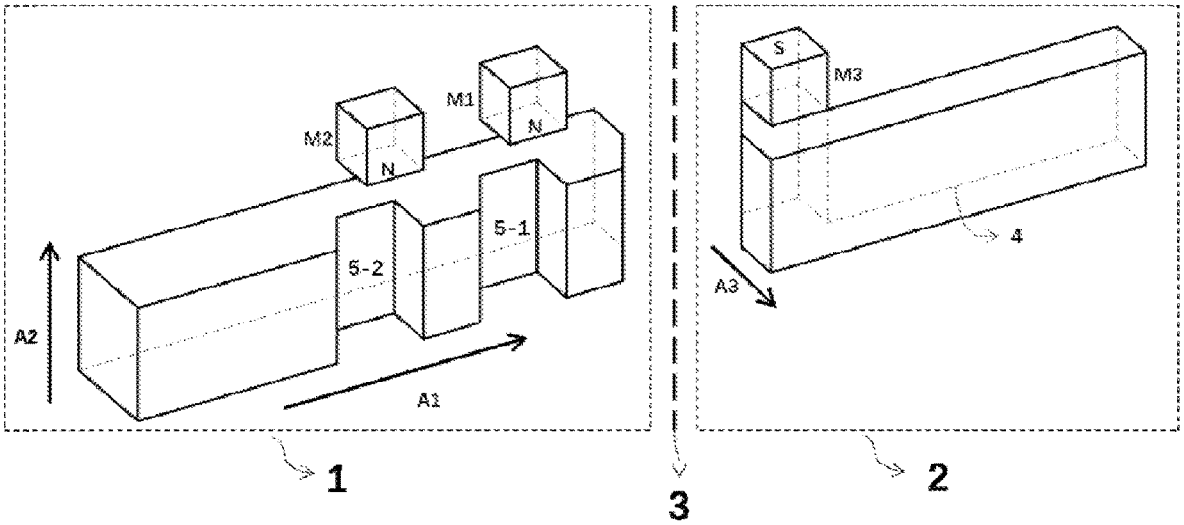
FIGS. 3A-3D are schematic diagrams of a specific locking device of the present invention.

As shown in FIG. 3A, M1, M2, and M3 are magnets. The N poles of M1 and M2 are configured to be downward, and the S pole of M3 is configured to be upward. The first connecting component 1 is provided with the first locking element with the gap 5-1 and the second locking element with the gap 5-2 arranged side by side, and the magnet M1 is provided above and coupled with the first locking element with the gap 5-1. The magnet M2 is provided above and coupled with the locking element with the gap 5-2. The second connecting component 2 includes the elastic locking member 4, and the magnet M3 is provided above the elastic locking member 4, so that in an engaged process of the locking element with the gap 5-1 or 5-2 with the elastic locking member 4, a magnetic force between the magnet M1 or M2 coupled with the locking element with the gap and the magnet M3 of the locking member makes it easier to realize an engagement. After the engagement, the magnet M1 or M2 and the magnet M3 of the locking member attract one another. Obviously, M1 and M2 can be replaced by armatures, and M3 is a magnet; or M1 and M2 are magnets, and M3 is an armature; or M1 and M2 are two poles of a magnet, and M3 is an armature. These combinations of the magnets and the armatures can realize the magnetic force between the above locking element with the gap and the locking member, which is easily conceivable to those skilled in the art.

During an engaged process of the first connecting component 1 with the elastic locking member 4 of the second connecting component 2 in the A1 direction, at an engaged moment, the elastic locking member 4 is squeezed to cause an elastic offset in the A3 direction and pulled by a magnetic force between M1 and M3. The magnetic force between M1 and M3 makes the locking process smoother and achieves a good good haptic.

Figure 3B:
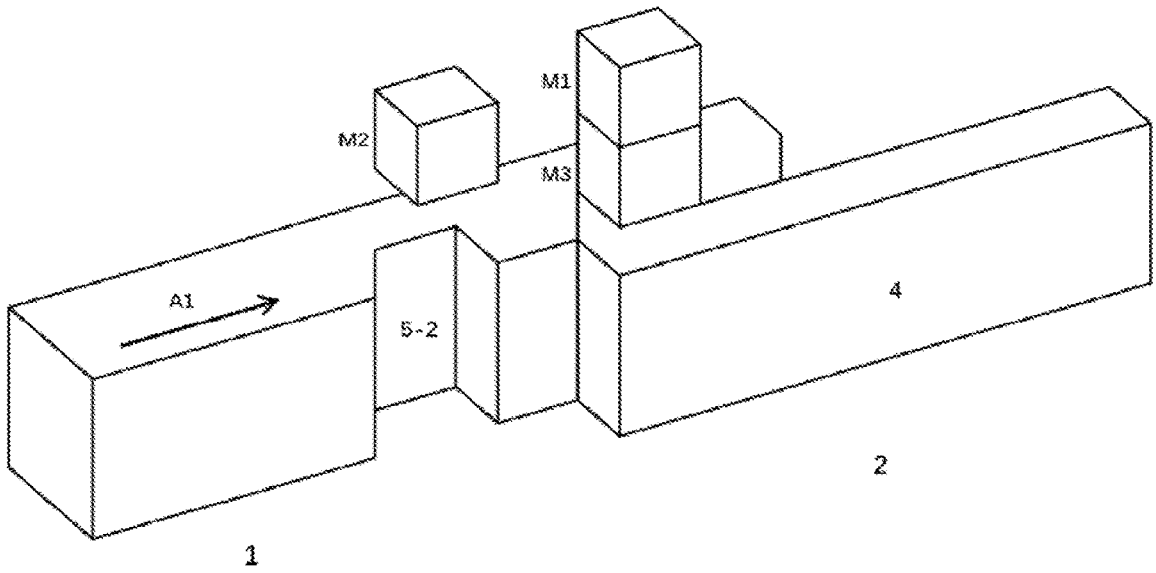

The elastic locking member 4 in FIG. 3B is provided with a hook-shaped head matched with the locking element with the gap 5-1 or 5-2. The first locking element with the gap 5-1 is engaged with the elastic locking member 4 to form locking in a main load direction (in this embodiment, the main load direction is opposite to the engaged direction of A1), i.e., a locked state in a first position. At this time, M1 and M3 attract each other, and the engaged state is stable. At this time, if the first connecting component 1 is further pushed in the A1 direction, an engagement of the second locking element with the gap 5-2 with the elastic locking member 4 is further formed, i.e., a locked state in a second position. At this time, M2 and M3 attract each other, and the engaged state is stable.

During a process of moving from the first locking element with the gap 5-1 to the second locking element with the gap 5-2, an attractive magnetic force is first strong, then turns weak and finally turns strong, having a large force contrast. The magnetic force interacts with an elasticity of the elastic locking member 4, which makes the good haptic in a process of adjusting positions more obvious.

Figure 3C:
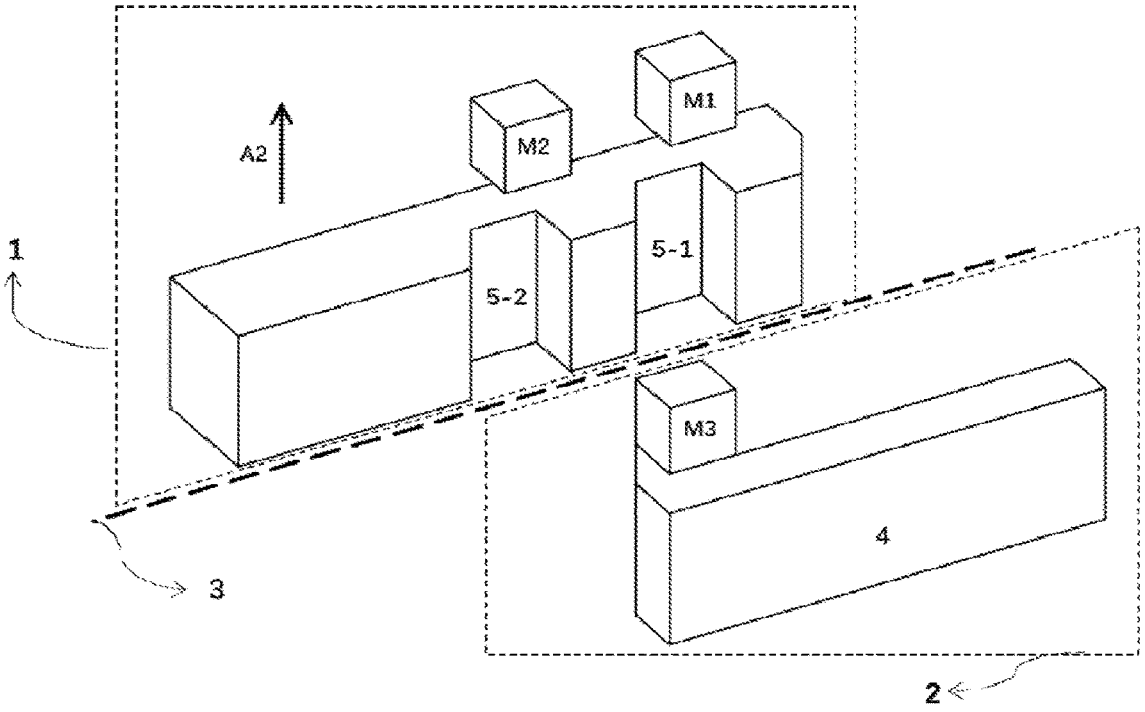

In FIG. 3C, the first connecting component 1 is withdrawn in the A2 direction, and the locking device is opened. The opening direction A2 is different from the main load direction. The attractive magnetic force between M1 and M3 needs to be overcome when opening. The attractive magnetic force can offset a non-human load shaking within a certain degree, so that the connection is not easy to open, and has firm and reliable effects. In a preferred embodiment, the opening direction A2 is at an obtuse angle or a right angle to the main load direction.

Figure 3D:
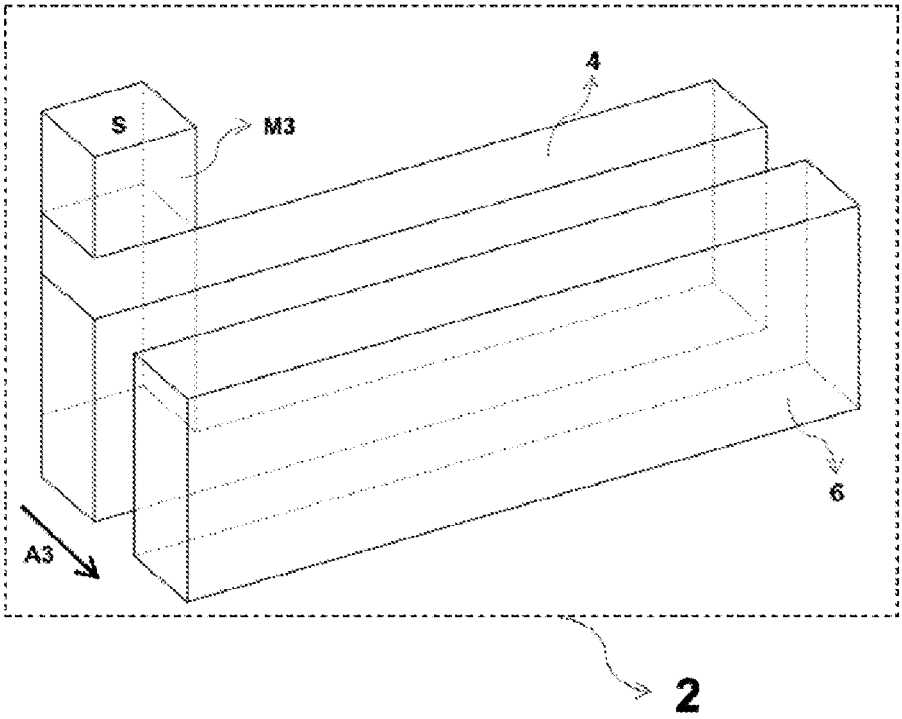

As shown in FIG. 3D, in order to avoid an excessive offset of the elastic locking member 4 in the A3 direction or an opposite direction of A3, the baffle 6 may be provided on the first connecting component 1 or the second connecting component 2.

The related principles shown in the above schematic diagrams 1 to 3 are described in detail below with the reference to specific embodiments.

Embodiment 1

Figure 4A:
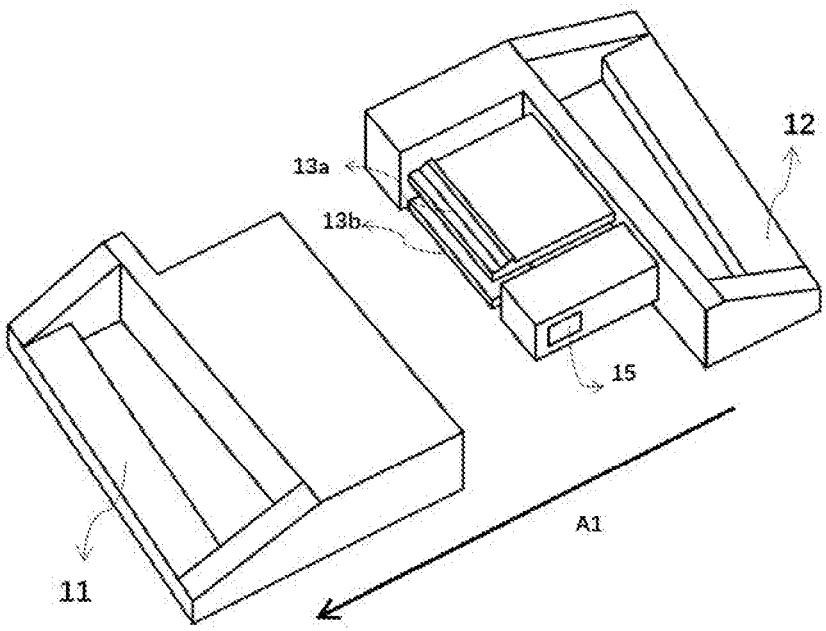
FIGS. 4A-4D show a first specific embodiment of the present invention.

The locking device shown in FIG. 4A is a locking device with one position, which is widely used in backpacks, belts or the like. The locking device includes the first connecting component 11 and the second connecting component 12. The first connecting component 11 is provided with one locking element with a gap 14 (as shown in FIG. 4C), and the locking element with the gap 14 is rigidly coupled with the magnet 16 (FIG. 4D). The second connecting component 12 is provided with one elastic locking member 13, and the elastic locking member 13 has the upper portion 13*a* and the lower portion 13*b*. The second connecting component 12 is engaged in the direction of A1 to squeeze the elastic locking member 13, and then the elastic locking member 13 is engaged into the locking element with the gap 14 to be immediately locked. After being locked, a relative movement between the first connecting component 11 and the second connecting component 12 in the A1 direction are no longer allowed. All movements refer to relative movements, and the first connecting component 11 is assumed to be fixed in this figure.

Figure 4B:
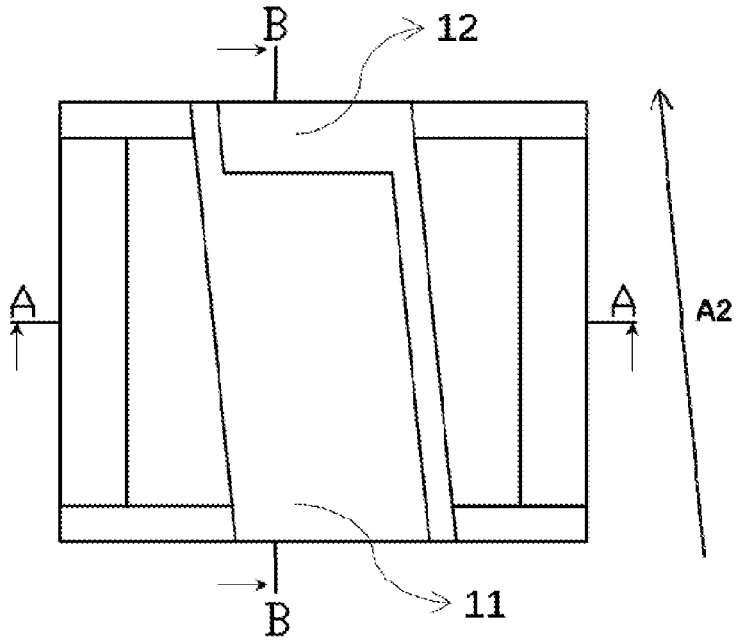
Figure 4C:
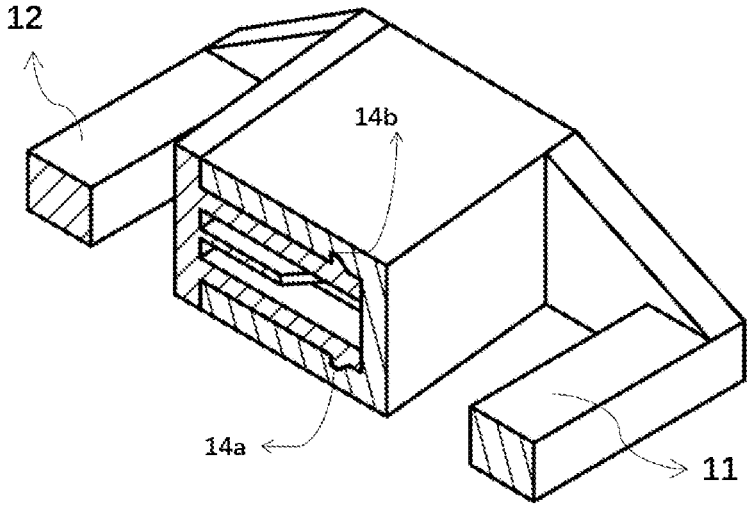
Figure 4D:
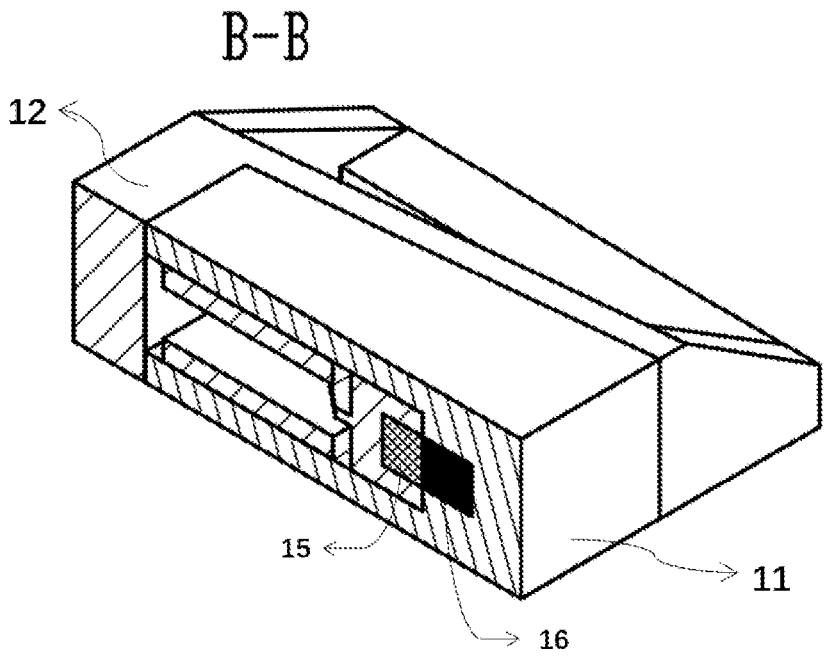

FIG. 4B shows a state in which the first connecting component 11 and the second connecting component 12 are locked. In this state, the second connecting component 12 is allowed to move only in the A2 direction relative to the first connecting component 11 for opening.

FIG. 4C is a cross-sectional view in an A-A direction of FIG. 4B. The locking element with the gap 14 is divided into two symmetrical portions including the upper portion 14*a* and the lower portion 14*b*, which are matched with two symmetrical wedge-shaped projections, i.e., the upper wedge-shaped projection 13*a* and lower wedge-shaped projection 13*b*, on the elastic locking member 13. The locking element with the gap 14 and the elastic locking member 13 are designed in two parts, which can improve a force distribution and enhance a locking capability compared to one part. The locking element with the gap 14 is a groove and the elastic locking member 13 is a wedge-shaped projection, such design is conductive to process. In other embodiments, the locking element with the gap may be a protrusion, and the elastic locking member is a groove, as long as the shapes can be matched with each other to form a self-locking.

FIG. 4D is a cross-sectional view in a B-B direction of FIG. 4B. In a locked state, the magnet 15 on the second connecting component 12 and the magnet 16 on the first connecting component 11 attract each other. Obviously, one of the magnet 15 and the magnet 16 may be replaced with an armature, which achieve the effect of mutual attraction as well.

Embodiment 2

Figure 5A:
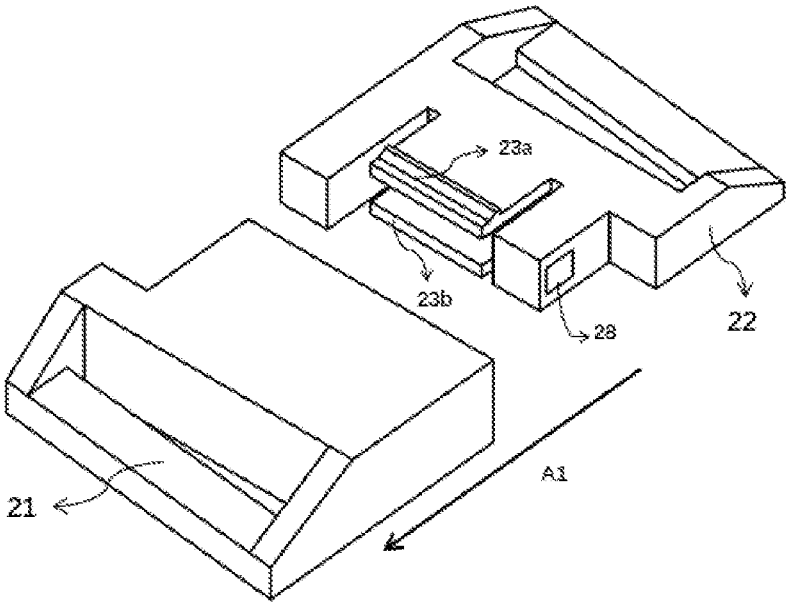
FIGS. 5A-5D show a second specific embodiment of the present invention.
Figure 5B:
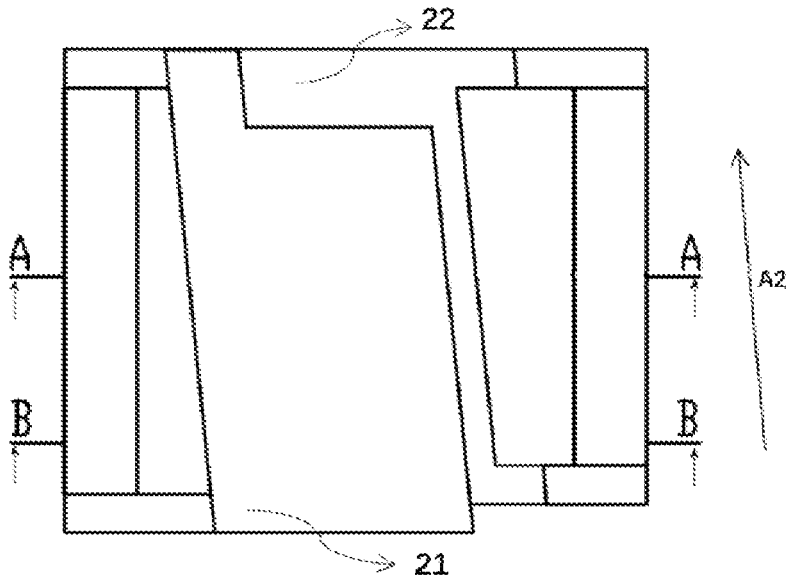
Figure 5C:
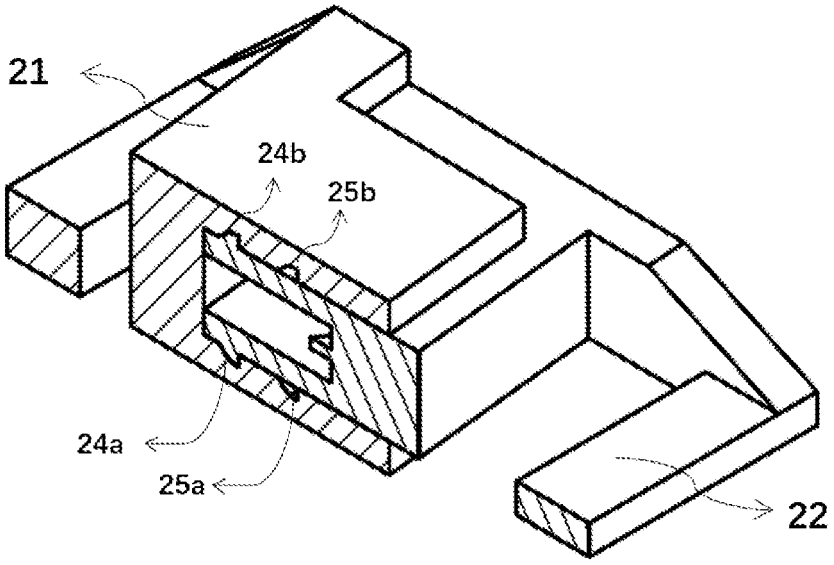

The locking device shown in FIGS. 5*a*-5*d* supports an adjustment of two positions, which is used for backpacks, belts and the like as well. The locking device includes the first connecting component 21 and the second connecting component 22, and the first connecting component 21 has two locking elements with gaps s including the first locking element with the gap 24 and the second locking element with the gap 25 (as shown in FIG. 5C). The second connecting component 22 is provided with the elastic locking member 23, and the elastic locking member 23 includes the upper portion 23*a* and the lower portion 23*b*; and the magnet 28 is provided on the second connecting component 22. The second connecting component 22 is engaged in the A1 direction, and when the elastic locking member 23 is engaged with the first locking element with the gap 24, the first position is formed. The second connecting component 22 continues to be engaged, when the elastic locking member 23 is engaged with the second locking element with the gap 25, the second position is formed. FIG. 5A is the same as FIG. 4A in that the second connecting component has only one elastic locking member, however, the first connecting component in the present structure has two locking elements with gaps s, and a specific structure can be seen in the cross-sectional view FIG. 5C.

FIG. 5B shows a locked state of the first connecting component 21 and the second connecting component 22. In this state, the second connecting component 22 is allowed to move only in the A2 direction relative to the first connecting component 21 for opening. The movement is a relative movement, and the first connecting component 21 is assumed to be fixed in this figure.

FIG. 5C is a cross-sectional view in an A-A direction of FIG. 5B. The first locking element with the gap 24 and the second locking element with the gap 25 are designed to be grooves. The first locking element with the gap 24 includes the upper portion 24*a* and the lower portion 24*b*. The second locking element with the gap 25 includes the upper portion 25*a* and the lower portion 25*b*. All of the upper portions and the lower portions can be matched with the upper portion 23*a* and the lower portion 23*b* of the elastic locking member 23 in shape.

Figure 5D:
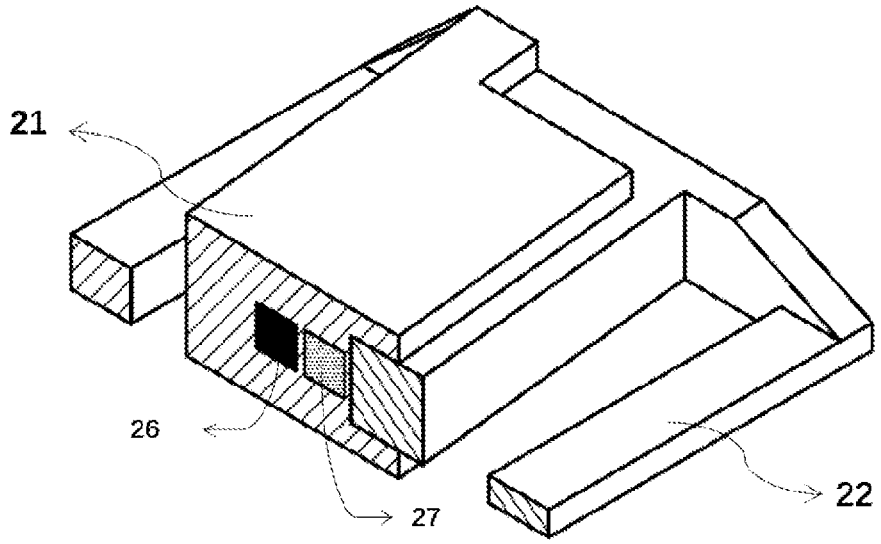

FIG. 5D is a cross-sectional view in a B-B direction of FIG. 5B. In the locked state of the first position, the magnet 27 and the magnet 28 attract to each other. In the locked state of the second position, the magnet 26 and the magnet 28 attract to each other. In some embodiments, the magnet 26 and the magnet 27 are two poles of a magnet, and the corresponding original magnet 28 is an armature, which achieves the effect of mutual attraction as well.

Embodiment 3

The locking device shown in FIGS. 6*a*-6*d* has a distinguishing feature of having two pairs of magnet-armature structures, wherein sizes of the magnet and the armature are different, and in a locked state, the magnet is not directly aligned with the armature. The locking device is characterized in that: the locking device is moved from the engaged position to the non-engaged position when opening, and a relative movement between the magnet and the armature may be a resultant movement of a forward moving away and a side approaching.

Figure 6A:
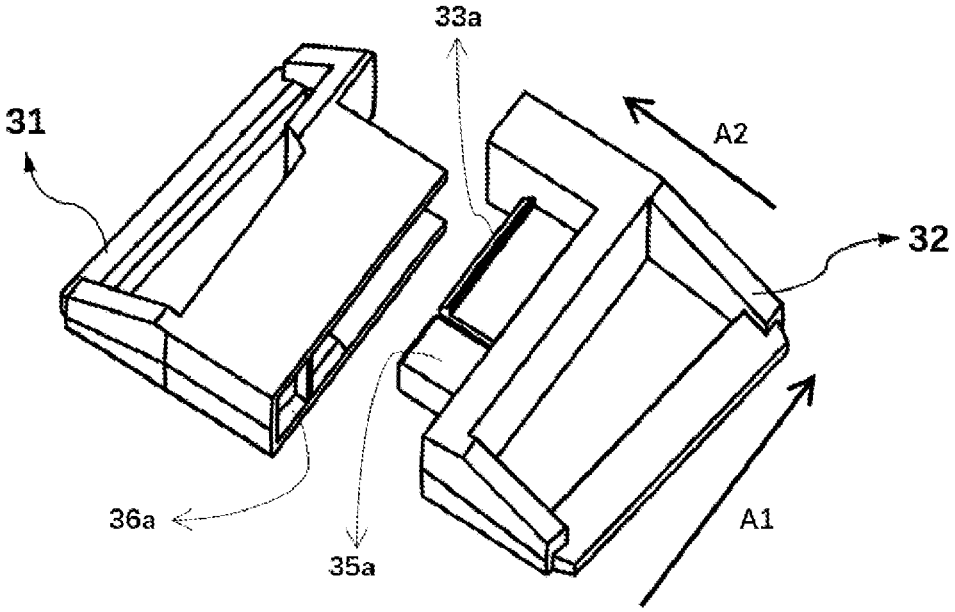
FIGS. 6A-6D show a third specific embodiment of the present invention.

FIG. 6A is a state diagram in which the first connecting component 31 is separated from the second connecting component 32. 33*a* is the elastic locking member, and 35*a* and 36*a* are the magnets. The second connecting component 32 is locked and engaged in the A2 direction.

Figure 6B:
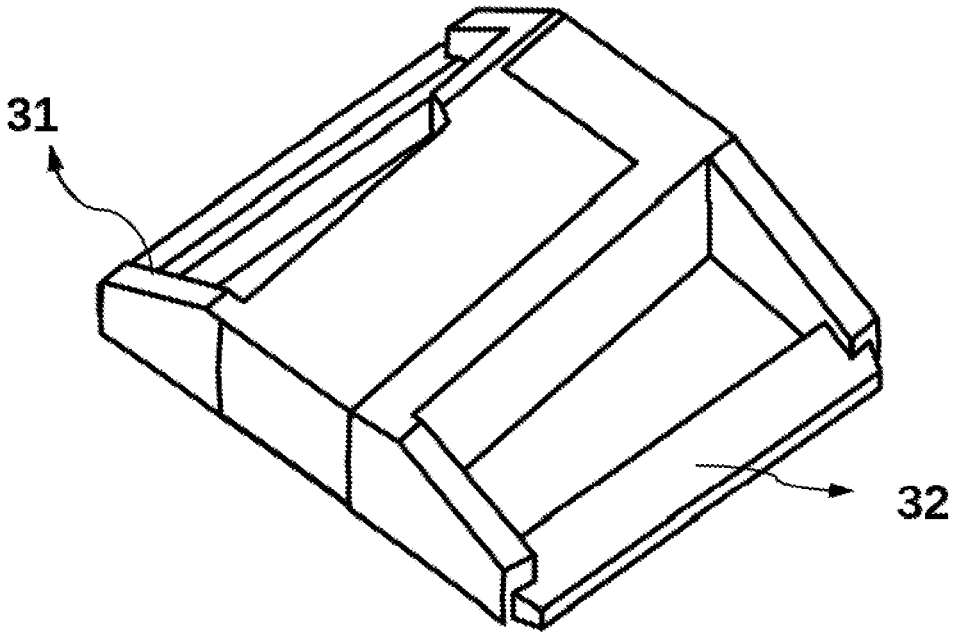

FIG. 6B is a diagram showing a locked state of the first connecting component 31 and the second connecting component 32.

Figure 6C:
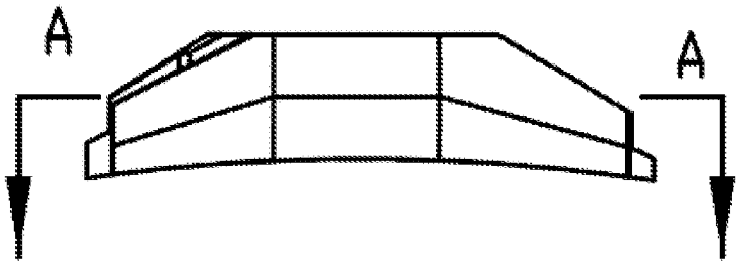

FIG. 6C is a front view of the locking device in a locked state.

Figure 6D:
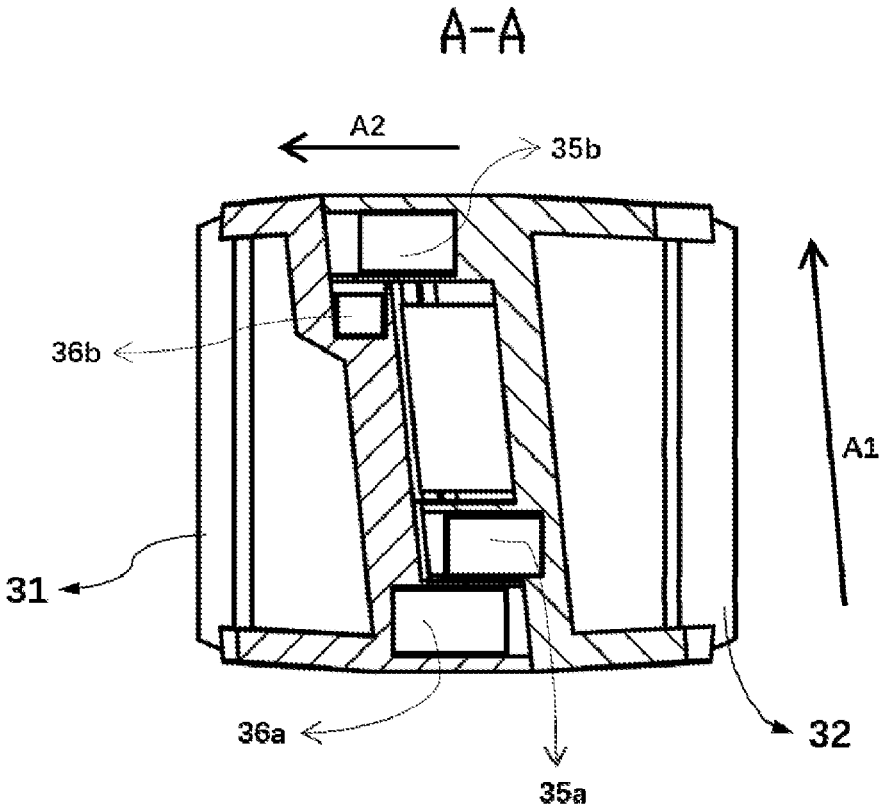

FIG. 6D is a cross-sectional view in an A-A direction of FIG. 6C. 35*b* and 36*b* are the magnets. The advantage of designing two pairs of magnets in this embodiment is that the magnetic force is enhanced and distributed uniformly, the locking is smoother, and the connection is firmer. Since the withdrawing direction A1 is at an obtuse angle with the main load direction (the main load direction is opposite to the engaged direction A2 in this embodiment), when the second connecting component 32 is withdrawn, the average spacing between 35*b* and 36*b* is gradually increased, but the magnetic attracting area is temporarily increased and then decreased, a combination of the average spacing and the magnetic attracting area also results in that the magnetic force is gradually weakened. In some embodiments, due to the different arrangements of magnet pairs, the magnetic force may be temporarily increased and then gradually weakened in the opening direction.

Embodiment 4

The distinguishing features of the locking device shown in FIGS. 7*a*-7*d* are that an opening manner is flipping, and the locking member and the locking element with the gap are not elastic.

Figure 7A:
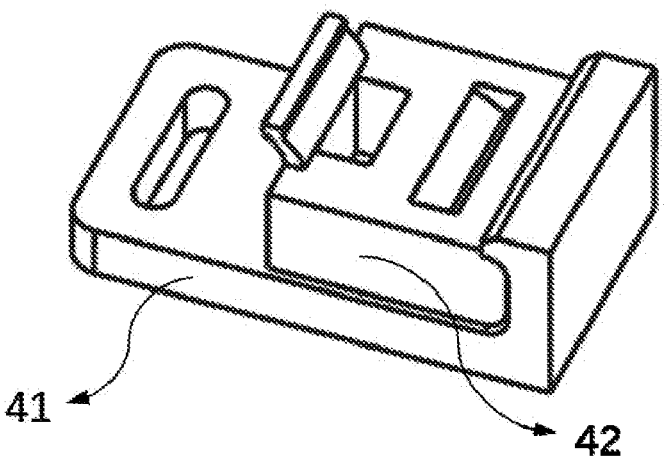
FIGS. 7A-7D show a fourth specific embodiment of the present invention.

In FIG. 7A, 41 is the first connecting component, and 42 is the second connecting component.

Figure 7B:
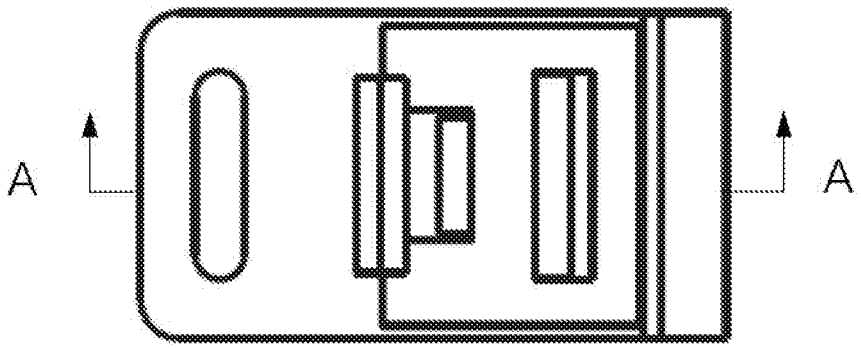
Figure 7C:
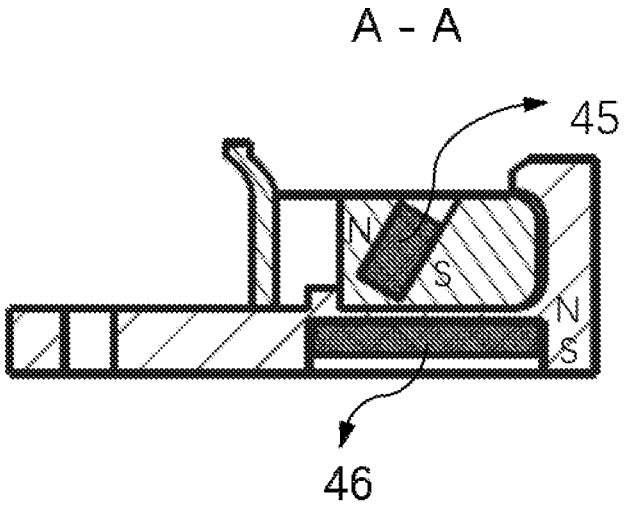

FIG. 7C is a cross-sectional view of a cross-sectional position of FIG. 7B. In the figure, 46 is the magnet of the first connecting component, and 45 is the magnet of the second connecting component. The position shown in FIG. 7A is the engaged position.

Figure 7D:
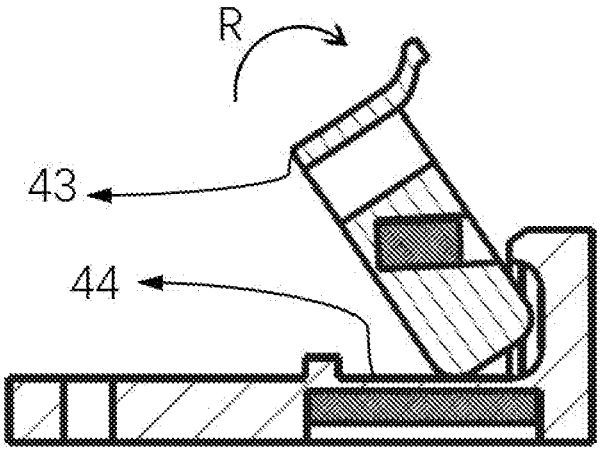

FIG. 7D shows a flipping state of the locking device during opening. 43 is the locking member, and 44 is the locking element with the gap. The opening direction of the locking device is the R direction. During the opening process, the magnetic attracting area between 45 and 46 is gradually increased, and the average spacing is also gradually increased. When the magnetic force is weak enough, 41 and 42 are no longer engaged with each other.

Embodiment 5

FIGS. 8*a*-8*e* show another embodiment. A feature of this embodiment is that positions of magnets are not directly aligned in an engaged state. When the positions of the magnets are not directly aligned, a property that the magnet has a higher magnetic density in a tip region makes the locking smoother.

Figure 8A:
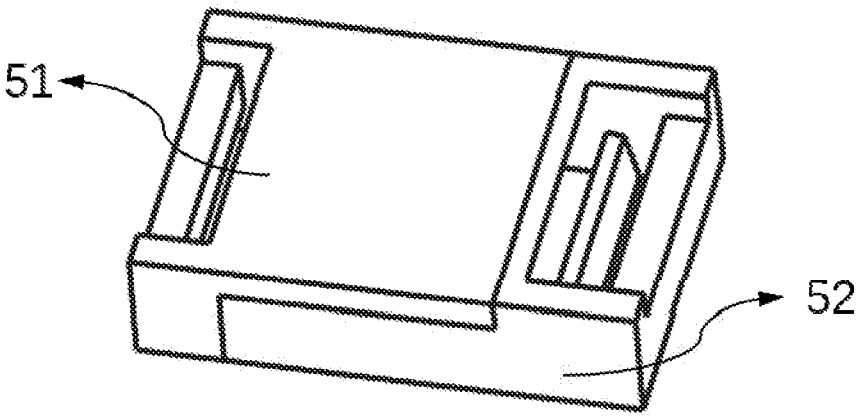
FIGS. 8A-8E show a fifth specific embodiment of the present invention.

In FIG. 8A, 51 is the first connecting component, and 52 is the second connecting component.

Figure 8B:
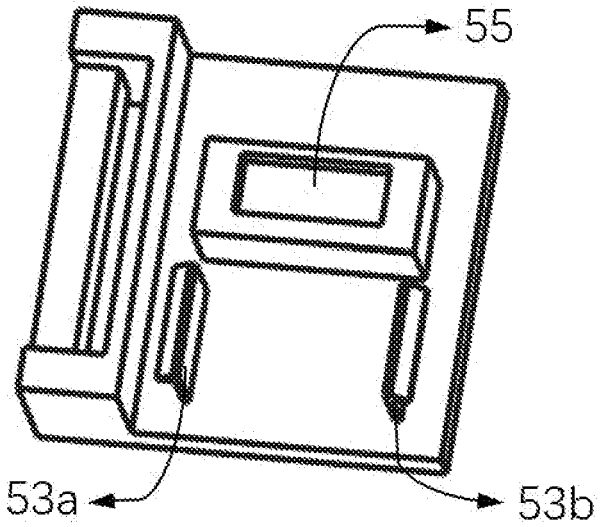

FIG. 8B is a structural diagram of the first connecting component 51, where 55 is the magnet, and 53*a* and 53*b* are elastic locking members.

Figure 8C:
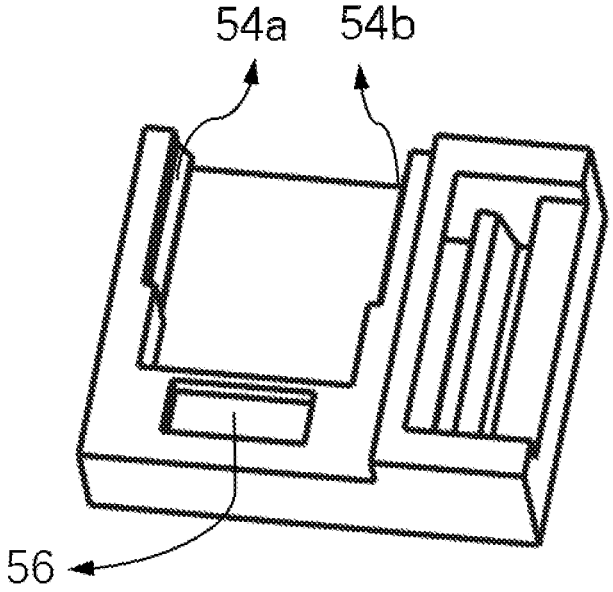

FIG. 8C is a structural diagram of the second connecting component 52, where 56 is the magnet, and 54*a* and 54*b* are locking elements with gaps, 54*a* and 54*b* are respectively matched with 53*a* and 53*b* in shape.

Figure 8D:
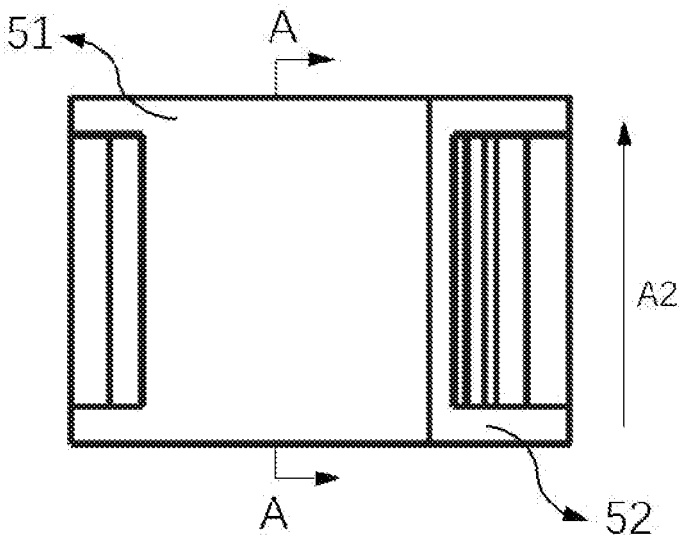

FIG. 8D is a diagram of an engaged state of 51 and 52. At this time, 55 and 56 attract each other, the structure is stable, and only a movement in the opening direction A2 is allowed.

Figure 8E:
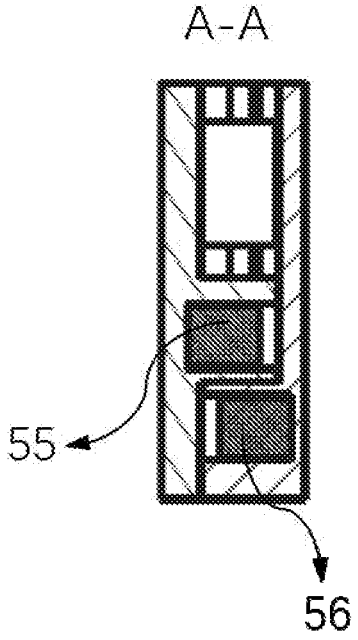

FIG. 8E is a cross-sectional view of an A-A position shown in FIG. 8D. At this time, the state is the engaged state, 55 and 56 attract each other, but are not directly aligned with each other.

Embodiment 6

FIGS. 9*a*-9*e* show another embodiment. Features of this embodiment are as follows: an opening manner is rotation, from the engaged position to the non-engaged position when opening, a magnetic attracting area is substantially unchanged, a magnetic force is also substantially unchanged, and after reaching the non-engaged position, the magnet is forward moving away and the magnetic force is gradually weakened.

Figure 9A:
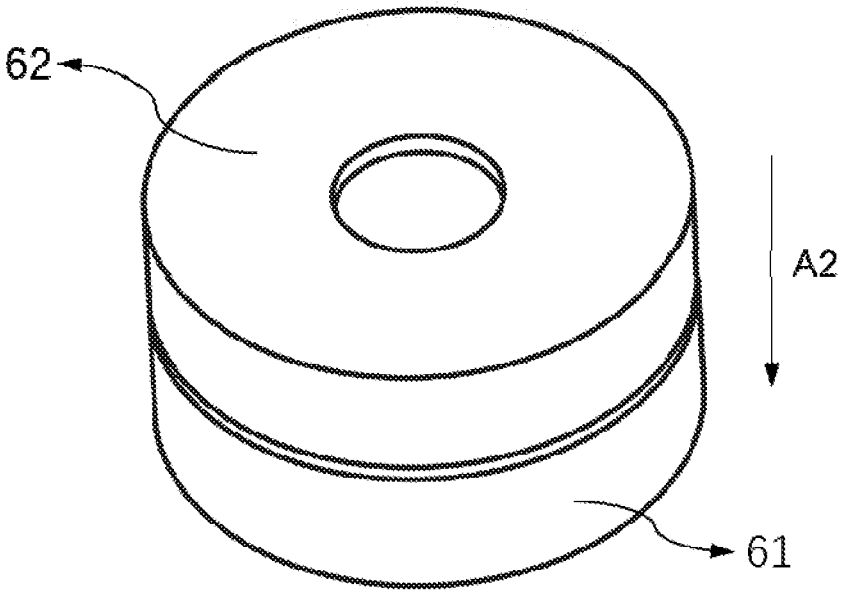
FIGS. 9A-9E show a sixth specific embodiment of the present invention.

In FIG. 9A, 61 is the first connecting component, and 62 is the second connecting component. 62 is inserted into 61 in the A2 direction.

Figure 9B:
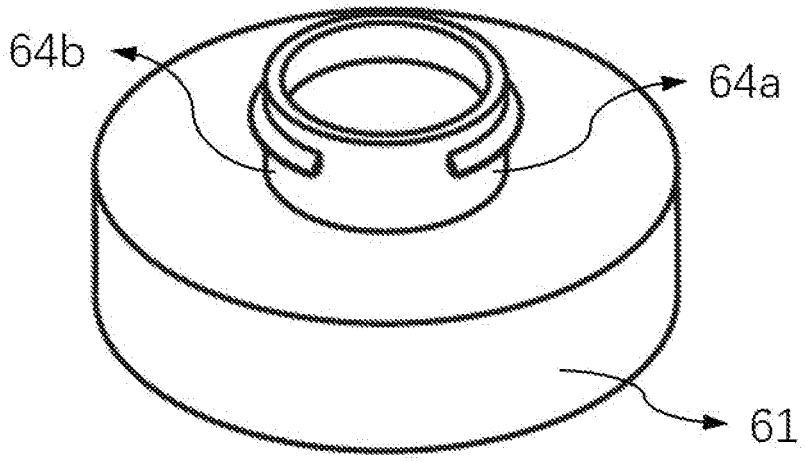

FIG. 9B is a structural diagram of the first connecting component, where 64*a* and 64*b* are two locking elements with gaps s.

Figure 9C:
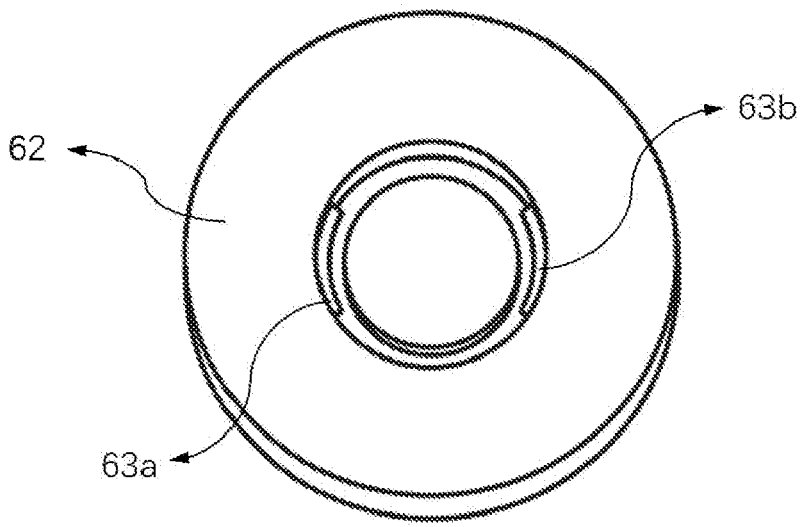

FIG. 9C is a structural diagram of the second connecting component, where 63*a* and 63*b* are two elastic locking members allowing for outward elastic expansion. 63 and 64 are engaged with each other to form a self-locking.

Figure 9D:
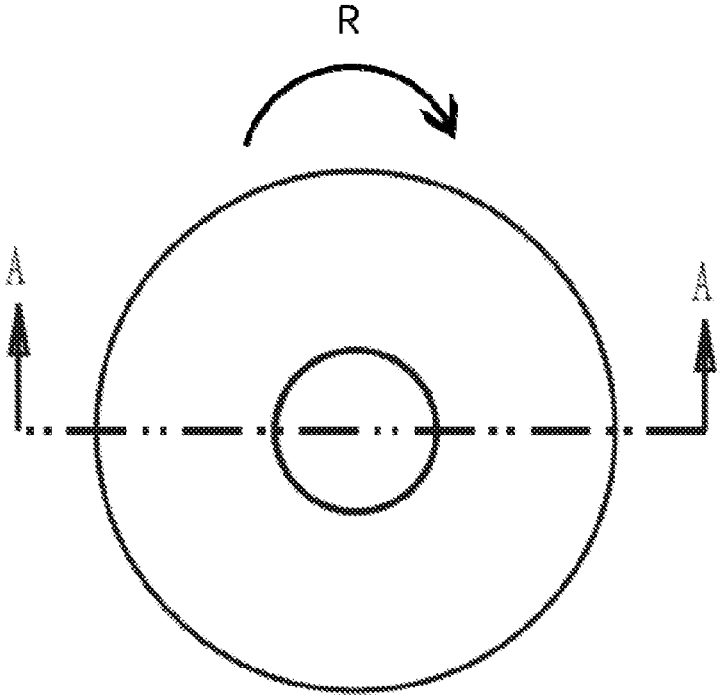

FIG. 9D is a plan view of an engaged state of 61 and 62. At this time, the rotation in the clockwise R direction is allowed. After rotating by 90°, the 61 and 62 are detached. In other embodiments, an angle of the rotation from the engaged position to the non-engaged position may vary.

Figure 9E:
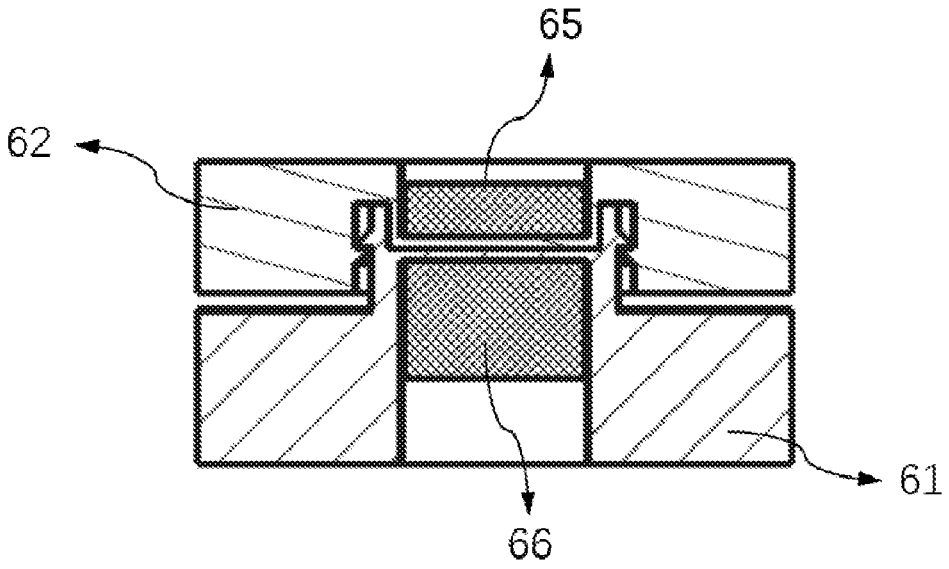

FIG. 9E is a cross-sectional view of a cross-sectional position shown in FIG. 9D, where 65 and 66 are magnets placed in a mutually attracted state. Both 65 and 66 are cylindrical magnets, so that the magnetic attracting area does not substantially change during the rotation.

Embodiment 7

This embodiment provides a tilting-type locking device, and an opening manner thereof is the opening mechanism of embodiment 4, which is a further embodiment of the structure of embodiment 4. A first fastening member in this embodiment corresponds to the first connecting component in embodiment 4, and a second fastening member corresponds to the second connecting component in embodiment 4.

Figure 10:
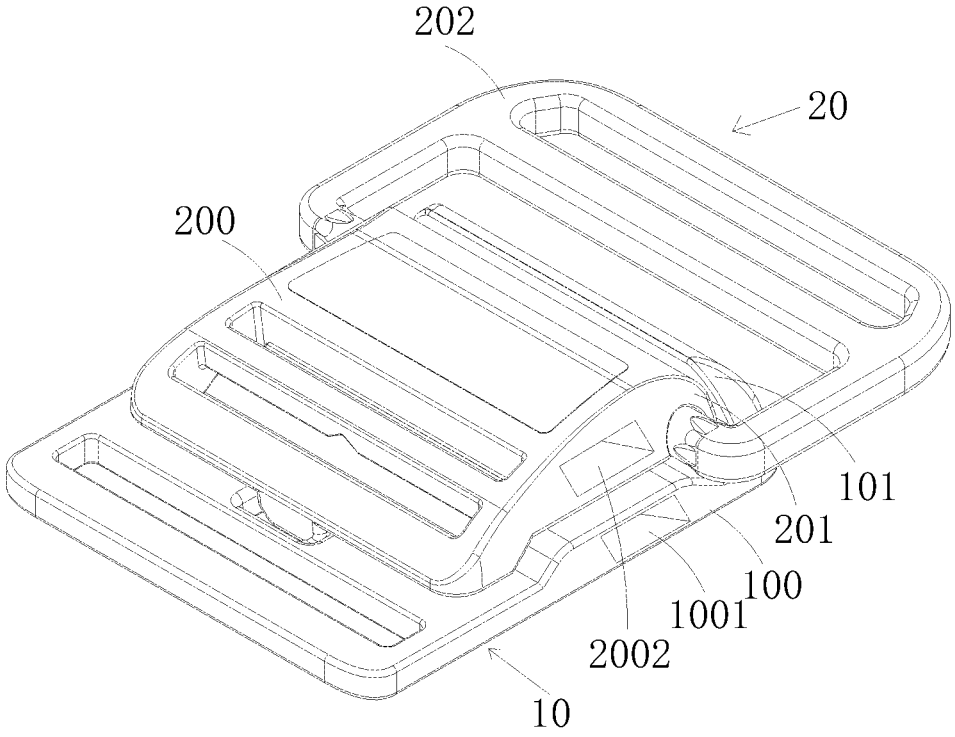
FIG. 10 is a diagram showing a structure of an embodiment in the present invention.
Figure 11:
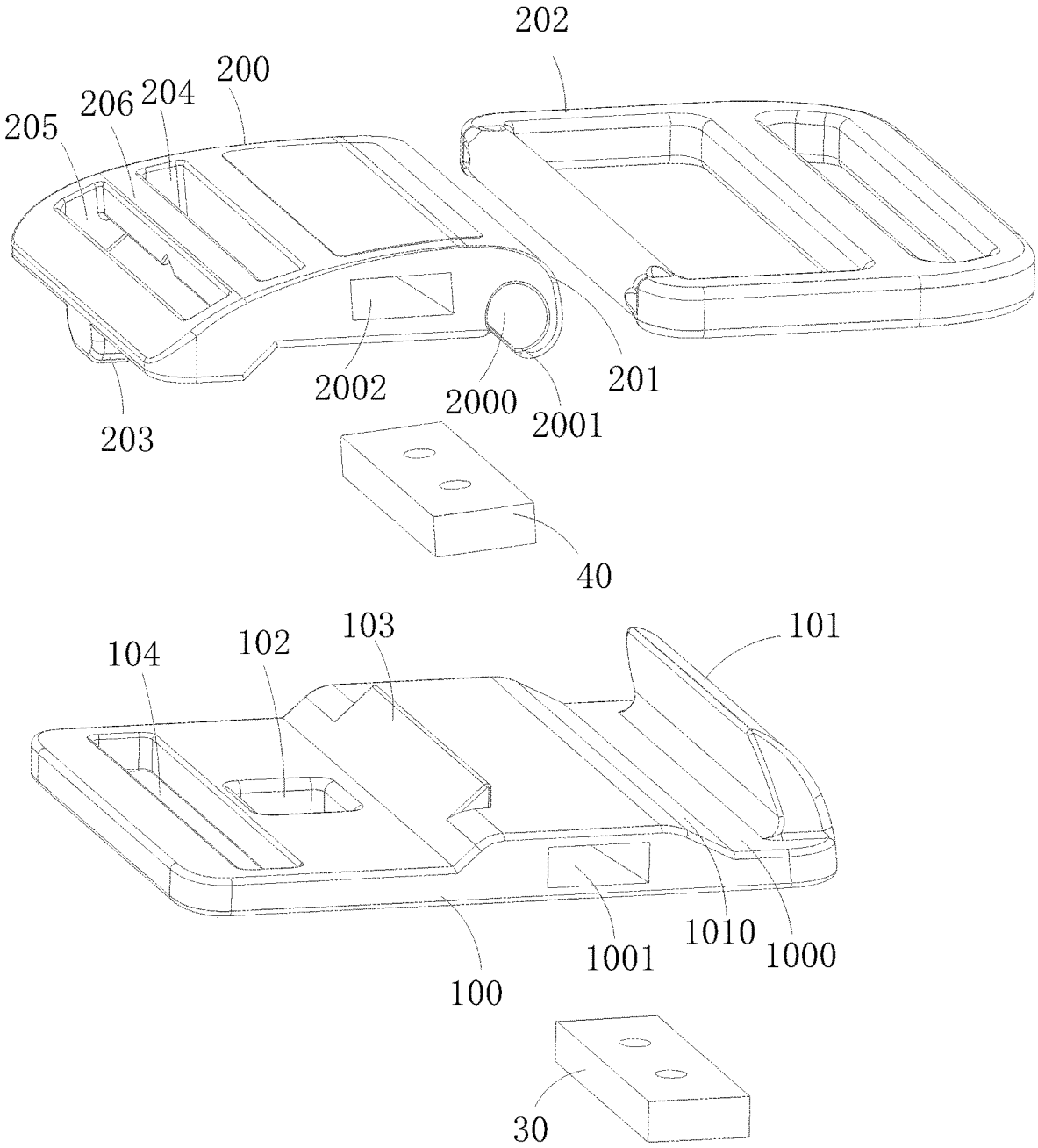
FIG. 11 is an exploded view showing the structure of the embodiment shown in FIG. 10.
Figure 12:
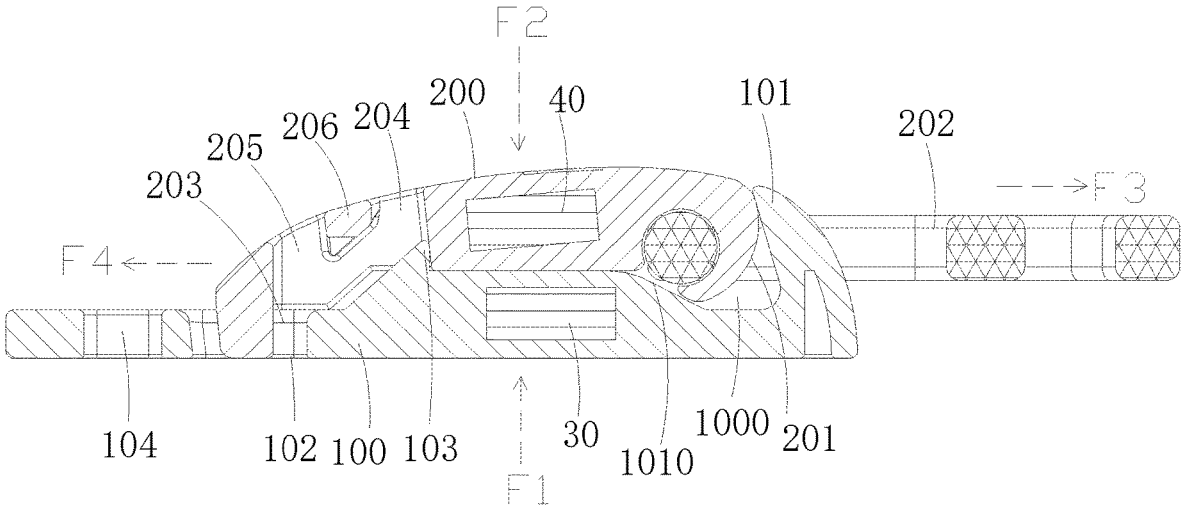
FIG. 12 is a cross-sectional view showing the structure of the embodiment shown in FIG. 10.

As shown in FIG. 10 to FIG. 12, the tilting-type locking device is configured for connecting a first component and a second component. The tilting-type locking device includes the first fastening member 10 fixed to the first component and the second fastening member 20 fixed to the second component. The first fastening member 10 includes the base 100, the first blocking portion 101 formed by extending upward from one end of the base 100, and at least one first locking structure 102 provided at the other end of the base 100. A dihedral angle of the first blocking portion 101 and the base 100 is not more than 90°, and a fastening space is formed between the first blocking portion 101 and the first locking structure 102. At least one first magnetic component 30 is provided on the base 100 at a position corresponding to the fastening space. The second fastening member 20 includes the magnetic attracting portion 200. The abutting portion 201 abutting against the first blocking portion 101 is provided at one end of the magnetic attracting portion 200, and the force applying member 202 for indirectly applying a force to the first blocking portion 101 through the abutting portion 201 is provided at the end. The second fastening member 20 is connected to the second component by the force applying member 202. The second locking structure 203 is provided on the magnetic attracting portion 200 at a position corresponding to a position of the first locking structure 102, and the second locking structure 203 is matched with the first locking structure 102 and movable in a magnetic attracting direction relative to the first locking structure 102. The second magnetic component 40 magnetically matched with the first magnetic component 30 is provided on the magnetic attracting portion 200 at a position corresponding to the first magnetic component 30.

In actual use, the first fastening member 10 is fixed to the first component, and the second fastening member 20 is connected to the second component by the force applying member 202. The first component and the second component may be respectively two separated parts that need to be connected in a backpack, a belt, a dog collar, etc. When the second fastening member 20 is magnetically attracted to the fastening space of the first fastening member 10, a connection of the two separated parts can be realized. The abutting portion 201 abuts against the first blocking portion 101, and the second locking structure 203 is locked with the first locking structure 102. Therefore, when the two separated parts are pulled left or right, the second fastening member 20 is not detached from the first fastening member 10 due to being blocked by the first blocking portion 101. When the first fastening member 10 and the second fastening member 20 need to be opened, a force is applied in an upper and lower magnetic direction between the first magnetic component 30 and the second magnetic component 40, at this time, the second fastening member 20 is not blocked by the first blocking portion 101 and the first locking structure 102. Thus, the second fastening member 20 can be detached from the first fastening member 10, and the two separated parts are opened. In FIG. 12, the force F1 and the force F2 indicate the upper and lower magnetic attraction directions. One of ordinary skill in the art should understand that a direction of the force applied to detach the first fastening member 10 from the second fastening member 20 in the upper and lower magnetic attraction direction is opposite to a direction of the force F1 or the force F2.

In this embodiment, a dihedral angle between the first blocking portion 101 and the base 100 is not more than 90°, thus, when the force applying member 202 is subjected to a pulling force from left or right, the first blocking portion 101 can well block the second fastening member 20 from being detached from the first fastening member 10; and when a force is applied in the upper and lower magnetic attraction direction, the first blocking portion 101 does not block the second fastening member 20 from being detached from the first fastening member 10. However, if the dihedral angle between the first blocking portion 101 and the base 100 is greater than 90°, that is, the first blocking portion 101 forms an obtuse angle with the base 100, at this time, after a force is applied by the force applying member 202 in the second fastening member 20, the second fastening member 20 may be detached from the first blocking portion 101 of the first fastening member 10, which is difficult to meet the use requirements.

Generally, the dihedral angle between the first blocking portion 101 and the base 100 is preferably set to be not less than 60° and not more than 90°, thus, the first blocking portion 101 can realize a good blocking effect in the left and right directions, and the second fastening member 20 can be easily detached from the first fastening member 10 in the upper and lower magnetic attraction directions. As shown in FIG. 12, in this embodiment, the dihedral angle of the first blocking portion 101 with respect to the base 100 is 70°.

In this embodiment, the force applying member 202 may be provided at a force applying position of the magnetic attracting portion 200 in a fixed connection manner, or the force applying member 202 may also be formed into one piece with the magnetic attracting portion 200.

Obviously, the force applying member 202 may also be pivotably provided at the force applying position of the magnetic attracting portion 200. For example, as shown in FIG. 11 and FIG. 12, an end of the base 100 close to the first blocking portion 101 is recessed downward from an upper surface to form the groove 1000. The first mounting groove 2000 recessed inwardly for mounting the force applying member 202 is provided on a lower surface of the magnetic attracting portion 200 at a position corresponding to the groove 1000. The hook portion 2001 for locking the force applying member 202 into the first mounting groove 2000 and capable of being accommodated in the groove 1000 is formed by a downward extension of a side surface of the first mounting groove 2000 close to the abutting portion 201. When the force applying member 202 is provided in the first mounting groove 2000, the hook portion 2001 makes a groove opening of the first mounting groove 2000 small relative to a space of the first mounting groove 2000. The force applying member 202 is not prone to be detached when mounted in the first mounting groove 2000, and the force applying member 202 is rotatable relative to the first mounting force applying 2000. Meanwhile, the force applying member 202 is closer to an upper surface of the base 100 of the first fastening member 10, and a force applying effect is better.

In this embodiment, as shown in FIG. 11 and FIG. 12, a side surface 1010 of the groove 1000 away from the first blocking portion 101 is slope-shaped, and an outer surface of the hook portion 2001 is arc-shaped. When the arc-shaped hook portion 2001 abuts against the slope-shaped side surface 1010 of the groove 1000, the arc-shaped hook portion 2001 slides relative to the slope-shaped side surface 1010 into the groove 1000. At this time, the second fastening member 20 can be automatically locked and magnetically attracted to the first fastening member 10, thus, this design is more convenient to lock the second fastening member 20 and the first fastening member 10 during use.

The force applying member 202 may be realized by a metal buckle or a plastic buckle. The metal buckle or the plastic buckle may usually be a square buckle with a crossbar provided in a middle, or a square buckle without a crossbar. Obviously, the metal buckle or the plastic buckle may also be designed into other shapes according to actual needs. Obviously, in other embodiments, the force applying member 202 may also be realized by a chain, a cable, a rope, etc.

As shown in FIG. 12, an upper end portion of the abutting portion 201 is abuts against an upper end portion of the first blocking portion 101, and a lower end portion of the abutting portion 201 is not in contact with a lower end portion of the first blocking portion 101. When the second fastening member 20 is horizontally placed, a height of the upper end portion of the abutting portion 201 is larger than a height of the first mounting groove 2000, and the lower end portion of the abutting portion 201 is lower than the height of the first mounting groove 2000. Generally, as shown in FIG. 12, the abutting portion 201 is designed to have a curved shape. Thus, when the force applying member 202 works, the force applying member 202 applies the force F3 on the first blocking portion 101. At this time, an interaction force is generated at a contact point position of the upper end portion of the abutting portion 201 and the upper end portion of the first blocking portion 101, thereby forming a moment of force allowing the second fastening member 20 to have a tendency to rotate around the contact point position between the abutting portion 201 and the first blocking portion 101. At this time, the second fastening member 20 is closer to the first fastening member 10, and a fixing effect between the second fastening member 20 and the first fastening member 10 is better.

In order to facilitate applying a force in the upper and lower magnetic attraction directions to detach the second fastening member 20 from the first fastening member 10, in this embodiment, a pulling member for pulling out the second fastening member 20 magnetically attracted to the first fastening member 10 is further provided on the magnetic attracting portion 200.

As shown in FIG. 11, in this embodiment, the pulling member is provided at one end of the magnetic attracting portion 200 away from the abutting portion 201, and the pulling member is a rope, a cloth strip, a handle, etc. When the pulling member is the rope or the cloth strip, the pulling member is usually movably connected to the magnetic attracting portion 200; when the pulling member is the handle, the pulling member is usually fixedly connected to the magnetic attracting portion 200 or formed into one piece with the magnetic attracting portion 200.

In this embodiment, the first magnetic component 30 may be fixed to the base 100 by a glue or a one-piece injection molding. The second magnetic component 40 may be fixed to the magnetic attracting portion 200 by the glue or the one-piece injection molding.

In this embodiment, as shown in FIG. 11, the first magnetic component 30 and the second magnetic component 40 are fixed by glue.

When the first magnetic component 30 and the second magnetic component 40 are provided by the one-piece injection molding, one of ordinary skill in the art can understand that the injection molding process is generally completed when the first fastening member 10 and the second fastening member 20 are processed.

The fixing manners of the first magnetic component 30 and the second magnetic component 40 may be different from each other. At least one of the first magnetic component 30 and the second magnetic component 40 may be fixed by the one-piece injection molding. In order to better limit the second fastening member 20, prevent the second fastening member 20 from a detachment in the left and right directions, and only allow to realize the opening and closing in the upper and lower magnetic attraction directions, in this embodiment, as shown in FIG. 11 and FIG. 12, the protruding second blocking portion 103 is further provided on the upper surface of the base 100 at a position corresponding to the fastening space. The accommodating groove hole 204 for accommodating the second blocking portion 103 is provided on the magnetic attraction portion 200 at a position corresponding to the second blocking portion 103. During use, the accommodating groove hole 204 accommodates the second blocking portion 103. When the force applying member 22 works, the abutting portion 21 is blocked by the first blocking portion 11 so that the second fastening member 2 does not detach from the first fastening member 1. When the force F4 opposite to the force F3 is applied to the second fastening member 20 in a direction away from the force applying member 202, the second fastening member 20 is blocked by the second blocking portion 103, and the second fastening member 20 also does not detach from the first fastening member 10, at this time, the second fastening member 20 can only achieve opening and closing in the upper and lower magnetic attraction directions.

As shown in FIG. 11, the accommodating groove hole 204 is a groove hole penetrating through the upper and lower surfaces of the magnetic attracting portion 200. The through hole 205 is provided between the groove hole and the second locking structure 203. The separating plate 206 is provided between the through hole 205 and the groove hole. The pulling member made of the rope, the cloth strip, or the like is movably fixed to the separating plate 206.

As shown in FIG. 11, in order to facilitate the mounting of the first fastening member 10 in the first component, the mounting buckle 104 for mounting the first fastening member 10 on the first component is further formed by an outward extension of an end of the base 100 away from the first blocking portion 101 of the base 100.

Obviously, in other embodiments, the first fastening member 10 may also be fixed to the first component in manners of bonding, screwing by a screw, etc., and the structure thereof is changed accordingly.

As shown in FIG. 11 and FIG. 12, the first locking structure 102 is a locking hole, and the second locking structure 203 is a protruding locking block provided on a lower surface of the magnetic attracting portion 200. When a magnetic force is performed, the locking block is locked in the locking hole to realize a limit function, and the locking block can move relative to the locking hole in the magnetic attraction direction. In other embodiments, alternatively, the first locking structure 102 may be designed as a locking block, and the second locking structure 203 is a locking hole provided on the lower surface of the magnetic attracting portion 200. Obviously, the first locking structure 102 and the second locking structure 203 may also be designed into other structures according to actual needs, as long as not affecting the separation of the second fastening member 20 from the first fastening member 10 due to a mutual blockage in the magnetic attraction direction.

In this embodiment, the first magnetic component 30 and the second magnetic component 40 may be both magnets; or, the first magnetic component 30 is a magnet, and the second magnetic component 40 is made of a metal material, such as an armature, etc, that can be magnetically attracted to the magnet; or, the first magnetic component 30 is made of a metal material, such as an armature, etc, that can be magnetically attracted to a magnet, and the second magnetic component 40 is the magnet. The user can select any one of the different embodiments according to actual needs and cost.

In this embodiment, as shown in FIG. 10, the first fastening member 10 and the second fastening member 20 are both square-shaped. Obviously, in other embodiments, the shapes of the first fastening member 10 and the second fastening member 20 may be designed according to actual needs to meet the requirements of practicality and aesthetics.

Embodiment 8

Figure 13:
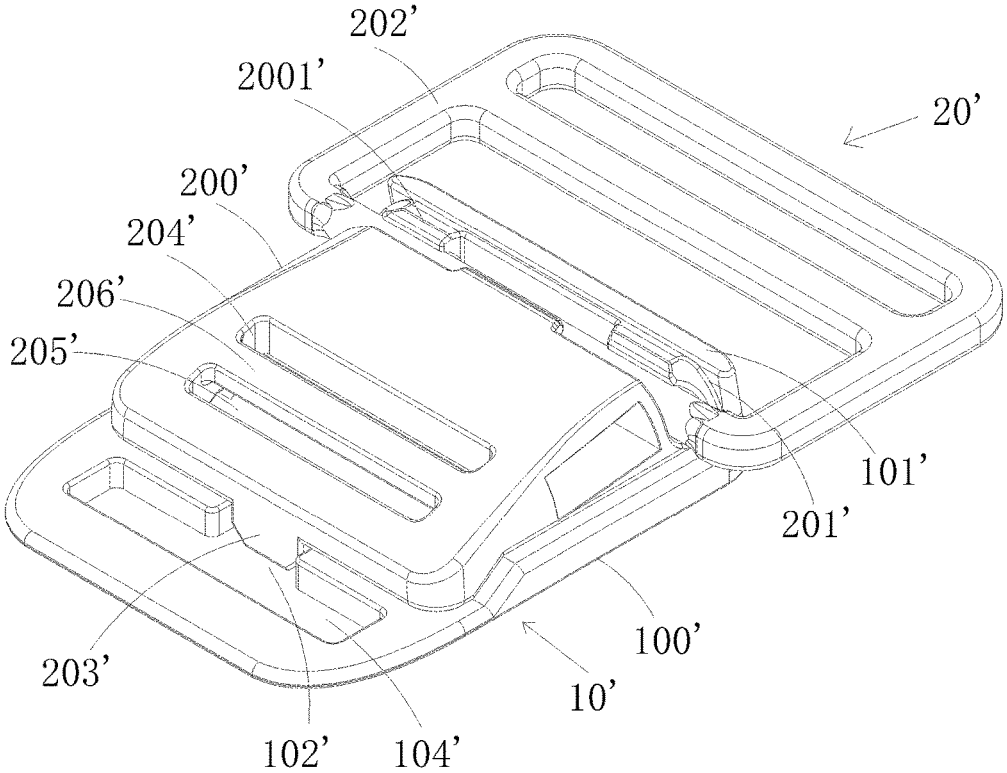
FIG. 13 is a diagram showing a structure of another embodiment of the present invention.
Figure 14:
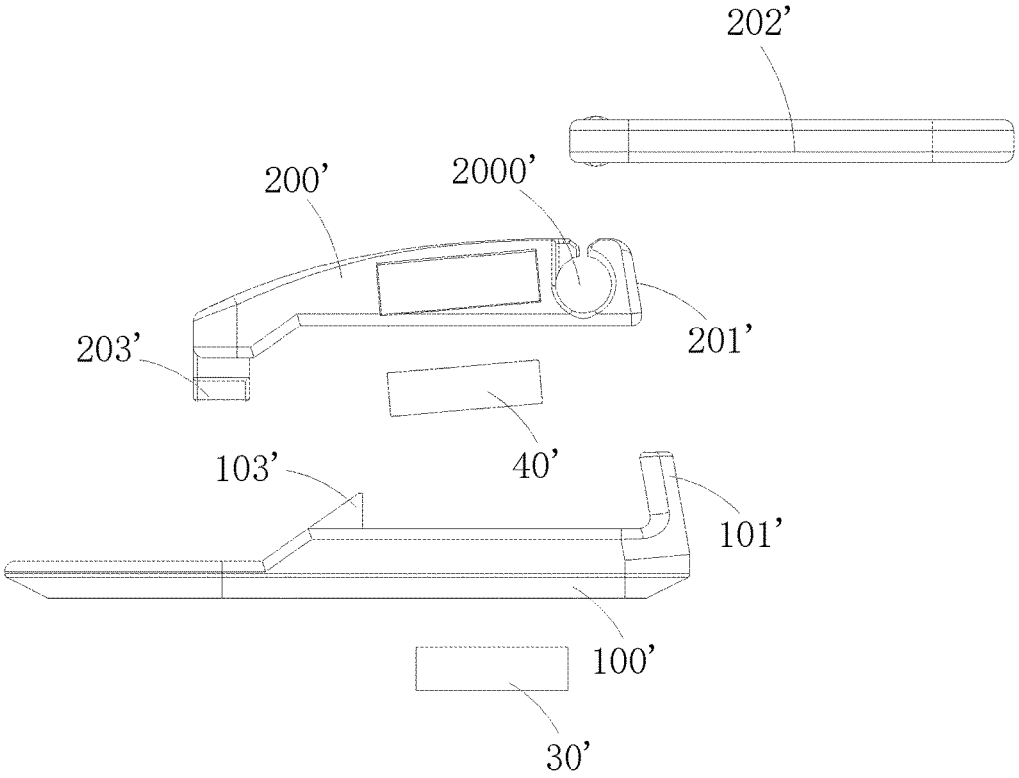
FIG. 14 is an exploded view showing the structure of the embodiment shown in FIG. 13.
Figure 15:
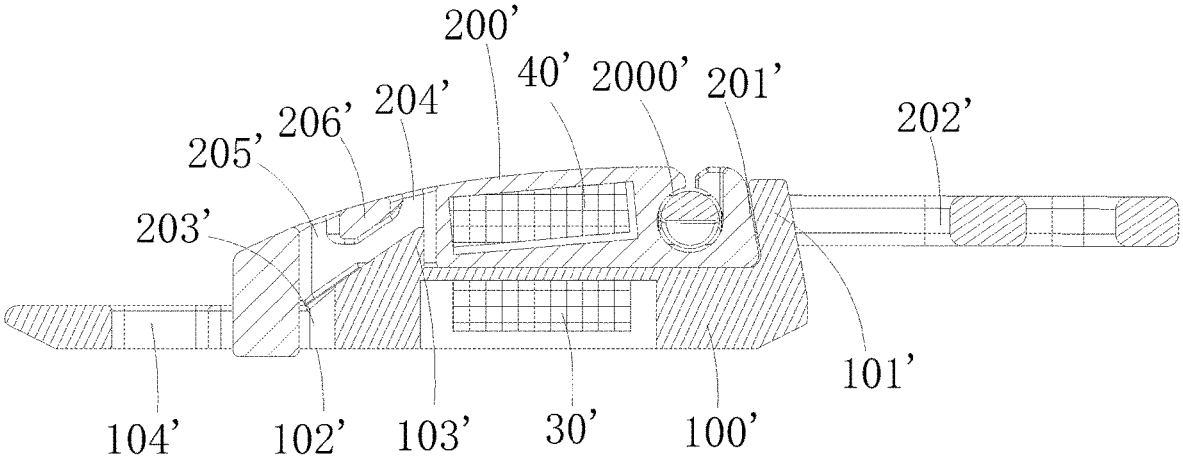
FIG. 15 is a cross-sectional view showing the structure of the embodiment shown in FIG. 13.

The basic structures of the first fastening members (100' and 100) and the second fastening members (200' and 200) in the tilting-type locking devices provided in embodiment 8 shown in FIGS. 13 to 15 and embodiment 7 are similar. Structural designs of the first locking structures (102' and 102) and the second locking structures (203' and 203), material selections of the first magnetic components (30' and 30) and the second magnetic components (40' and 40), etc. are similar. The difference thereof is that, as shown in FIGS. 14 and 15, a dihedral angle of the first blocking portion 101' with respect to the base 100' is 80°. The force applying member 202' is also pivotally provided at a force applying position of the magnetic attracting portion 200', but the position of the force applying member 202' is different from that of embodiment 7. Specifically, as shown in FIG. 13 and FIG. 14, the second mounting groove 2000' for mounting the force applying member 202' is recessed downward from an upper surface at one end of the magnetic attracting portion 200' close to the abutting portion 201'. A plurality of protruding blocks 2001' for locking the force applying member 202' in the second mounting groove 2000' are provided at two sides of an upper opening of the second mounting groove 2000'.

When the force applying member 202' is provided in the second mounting groove 2000', the protruding blocks 2001' prevents the force applying member 202' from coming out of the second mounting groove 2000', and the force applying member 202' is rotatable relative to the second mounting groove 2000'. Meanwhile, since the force applying member 202' is provided in the second mounting groove 2000' formed at the upper surface of the magnetic attracting portion 200', the lower bottom surface of the magnetic attracting portion 200' is relatively flat, and accordingly, the upper surface of the base 100' of the first fastening member 10' does not need to be provided with a structure such as a groove, etc., and the structure is simpler. In addition, the magnetic state and the forced process of the first fastening member 10' and the second fastening member 20' are similar to those in embodiment 7, which are not described herein.

In addition, as shown in FIG. 15, the abutting portion 201' is designed to be matched with the first blocking portion 101', and the abutting portion 201' is fitted with and abuts against an inner side surface of the first blocking portion 101', which can achieve a good abutting effect as well.

Similarly, the method of fixing the first magnetic component 30' and the second magnetic component 40' may be a glue bonding method or an one-piece injection molding method.

The above descriptions are merely the preferred embodiments of the present invention, which are further detailed description of the present invention in combination with the specific preferred embodiments, and cannot be concluded that the specific implementation of the present invention is limited to these embodiments. Any modifications, equivalent substitutions and improvements made within the spirit and principles of the present invention should be included in the protective scope of the present invention.

What is claimed is:

1. A mechanical-magnetic locking device, comprising: a first connecting component, a second connecting component and a magnet-armature structure; wherein the first connecting component is provided with a locking element with a gap, the second connecting component is provided with a locking member matched with the locking element with the gap in shape; a magnet is provided on the first connecting component, an armature is provided on the second connecting component, the magnet of the first connecting component is coupled to the locking element with the gap, and the armature of the second connecting component is coupled to the locking member; or, a magnet is provided on the second connecting component, an armature is provided on the first connecting component, the armature of the first connecting component is coupled to the locking element with the gap, and the magnet of the second connecting component is coupled to the locking member; wherein during locking of the locking device, the magnet of the first connecting component or the magnet of the second connecting component and the armature of the second connecting component or the armature of the first connecting component approach each other, and the locking element with the gap and the locking member are moved from a non-engaged position to an engaged position by attractive magnetic force to form locking; and when opening the locking device, the magnet of the first connecting component or the magnet of the second connecting component moves relative to the armature of the second connecting component or the armature of the first connecting component, and a magnetic attracting area of the magnet of the first connecting component and the armature of the second connecting component, or the magnetic attracting area of the magnet of the second connecting component and the armature of the first connecting component is substantially unchanged or increased, allowing the locking element with the gap and the locking member to be moved from the engaged position to the non-engaged position; upon reaching the non-engaged position, the magnet of the first connecting component or the magnet of the second connecting component moves relatively away from the armature of the second connecting component or the armature of the first connecting component until the magnetic force between the magnet of the first connecting component and the armature of the second connecting component, or the magnetic force between the magnet of the second connecting component and the armature of the first connecting component is sufficiently weakened to separate the first connecting component from the second connecting component.

2. The mechanical-magnetic locking device of claim 1, wherein, during opening, when the locking element with the gap and the locking member are moved from the engaged position to the non-engaged position, a relative movement between the magnet of the first connecting component or the magnet of the second connecting component and the armature of the second connecting component or the armature of the first connecting component comprises one movement or a combination of at least two movements selected from the group consisting of a forward moving away, a side approaching, a forward flipping, and a rotation.

3. The mechanical-magnetic locking device of claim 2, wherein, during opening, when the locking element with the gap and the locking member are moved from the engaged position to the non-engaged position, the relative movement between the magnet of the first connecting component or the magnet of the second connecting component and the armature of the second connecting component or the armature of the first connecting component is a resultant movement of the forward moving away and the side approaching.

4. The mechanical-magnetic locking device of claim 1, wherein, when opening the locking device, the magnet of the first connecting component or the magnet of the second connecting component and the armature of the second connecting component or the armature of the first connecting component are flipped relative to each other, the magnetic attracting area is increased, allowing the locking element with the gap and the locking member to move from the engaged position to the non-engaged position; upon reaching the non-engaged position, the magnet of the first connecting component or the magnet of the second connecting component and the armature of the second connecting component or the armature of the first connecting component continue to flip until the magnetic force between the magnet of the first connecting component and the armature of the second connecting component, or the magnetic force between the magnet of the second connecting component and the armature of the first connecting component is sufficiently weakened to separate the first connecting component from the second connecting component.

5. The mechanical-magnetic locking device of claim 1, wherein, when opening the locking device, and the locking element with the gap and the locking member are moved from the engaged position to the non-engaged position, the attractive magnetic force between the magnet of the first connecting component and the armature of the second connecting component, or the attractive magnetic force between the magnet of the second connecting component and the armature of the first connecting component provides a restoring force to make the locking element with the gap and the locking member return to the engaged position.

6. The mechanical-magnetic locking device of claim 1, wherein, at least one of the first connecting component or the second connecting component is provided with an elastic structure.

7. The mechanical-magnetic locking device of claim 1, wherein, the first connecting component is provided with one or a plurality of locking elements with gaps.

8. The mechanical-magnetic locking device of claim 1, wherein, the magnet-armature structure comprises at least one magnet-armature pair.

9. The mechanical-magnetic locking device of claim 1, wherein, the magnet of the first connecting component or the magnet of the second connecting component is not directly aligned with the armature of the second connecting component or the armature of the first connecting component when the locking element with the gap and the locking member are in the engaged position.

10. The mechanical-magnetic locking device of claim 1, wherein, the locking device further comprises a chamber, and the chamber comprises a functional module and a power source.

11. The mechanical-magnetic locking device of claim 1, wherein, the second connecting component comprises a plurality of locking members or a locking member with a plurality of locking segments.

12. The mechanical-magnetic locking device of claim 1, wherein, the first connecting component comprises a base, a first blocking portion extending upward from one end of the base, and at least one first locking structure provided at an other end of the base, a dihedral angle between the first blocking portion and the base is not more than 90°, and a fastening space is formed between the first blocking portion and the first locking structure, and at least one first magnet or first armature is provided on the base at a position corresponding to the fastening space; and the second connecting component comprises a magnetic attracting portion, an abutting portion abutting against the first blocking portion is provided at one end of the magnetic attracting portion and a force applying member for indirectly applying a force to the first blocking portion through the abutting portion is provided at an other end of the magnetic attracting portion, the second connecting component is connected to the second component by the force applying member, a second locking structure is provided on the magnetic attracting portion at a position corresponding to the first locking structure, and the second locking structure is matched with the first locking structure and movable in the magnetic direction relative to the first locking structure, and a second magnet or a second armature magnetically attracted to the first magnet or the first armature is provided on the magnetic attracting portion at a position corresponding to the first magnet or the first armature.

13. The mechanical-magnetic locking device of claim 12, wherein, a protruding second blocking portion is further provided on an upper surface of the base at a position corresponding to the fastening space; and an accommodating groove hole for accommodating the protruding second blocking portion is provided on the magnetic attraction portion at a position corresponding to the protruding second blocking portion.

14. The mechanical-magnetic locking device of claim 12, wherein, the force applying member is pivotally provided on the magnetic attracting portion.

15. The mechanical-magnetic locking device of claim 14, wherein, an end of the base beside the first blocking portion is recessed downward from the upper surface to form a groove, a first mounting groove recessed inwardly for mounting the force applying member is provided on the magnetic attracting portion at a position corresponding to the groove, a hook portion for locking the force applying member into the first mounting groove and configured to be accommodated in the groove is formed by a downward extension of a side surface of the first mounting groove beside the abutting portion.

16. The mechanical-magnetic locking device of claim 14, wherein, a second mounting groove for mounting the force applying member is recessed downward from an upper surface at the one end of the magnetic attracting portion beside the abutting portion; and a plurality of protruding blocks for locking the force applying member in the second mounting groove are provided at two sides of an upper opening of the second mounting groove.

17. The mechanical-magnetic locking device of claim 12, wherein, an upper end portion of the abutting portion abuts against an upper end portion of the first blocking portion, and a lower end portion of the abutting portion is not in contact with a lower end portion of the first blocking portion.

18. The mechanical-magnetic locking device of claim 12, wherein, the magnetic attracting portion further comprises a pulling member for pulling out the second connecting component when the second connecting component is magnetically attracted to the first connecting component.

19. The mechanical-magnetic locking device of claim 12, wherein, the first magnet or the first armature is fixed to the base by a glue or a one-piece injection molding; the second armature or the second magnet is fixed to the magnetic attraction portion by the glue or the one-piece injection molding.

20. The mechanical-magnetic locking device of claim 12, wherein, a mounting buckle for mounting a first fastening member on the first component is formed by an outward extension of an end of the base away from the first blocking portion of the base.

* * * * *